US008739764B2

(12) United States Patent
Nakamura et al.

(10) Patent No.: US 8,739,764 B2
(45) Date of Patent: Jun. 3, 2014

(54) METHOD FOR CORRECTING FUEL INJECTION AMOUNT IN COMMON-RAIL-TYPE FUEL INJECTION CONTROL DEVICE AND COMMON-RAIL-TYPE FUEL INJECTION CONTROL DEVICE

(75) Inventors: Shigeyoshi Nakamura, Saitama (JP); Yasuhito Kirita, Saitama (JP); Osamu Mori, Saitama (JP)

(73) Assignee: Bosch Corporation, Tokyo (JP)

( * ) Notice: Subject to any disclaimer, the term of this patent is extended or adjusted under 35 U.S.C. 154(b) by 329 days.

(21) Appl. No.: 13/414,017

(22) Filed: Mar. 7, 2012

(65) Prior Publication Data

US 2012/0234294 A1 Sep. 20, 2012

(30) Foreign Application Priority Data

Mar. 17, 2011 (JP) ..... 2011-059511

(51) Int. Cl.
*F02D 41/04* (2006.01)
*F02D 41/24* (2006.01)
*F02D 41/14* (2006.01)

(52) U.S. Cl.
CPC ..... *F02D 41/04* (2013.01); *F02D 41/14* (2013.01); *F02D 41/24* (2013.01)
USPC ..... 123/479; 701/114

(58) Field of Classification Search
USPC ..... 123/436, 472, 478, 479, 486, 559.1; 701/104, 107, 110, 114; 73/114.25, 73/114.38, 114.45, 114.48
See application file for complete search history.

(56) References Cited

U.S. PATENT DOCUMENTS

| | | | | |
|---|---|---|---|---|
| 5,385,129 | A * | 1/1995 | Eyberg | 123/436 |
| 6,694,945 | B2 * | 2/2004 | Kawaguchi et al. | 123/299 |
| 6,907,861 | B2 * | 6/2005 | Asano et al. | 123/395 |

FOREIGN PATENT DOCUMENTS

JP 2005-036788 A 2/2005

* cited by examiner

*Primary Examiner* — Mahmoud Gimie
(74) *Attorney, Agent, or Firm* — Michael Best & Friedrich LLP

(57) ABSTRACT

A common-rail-type fuel injection control device where an error in the correction of a fuel injection amount when an exhaust brake is used is eliminated enabling a more reliable correction of a fuel injection amount.
A minute injection is performed plural times in a non-injection state. A difference between a reference energizing time, which becomes the reference for a fuel injection valve, and an actual energizing time based on a frequency component corresponding to a variation in an engine speed which is generated in the minute injection is learned. A correction control corrects an energizing time and timing. The correction control is corrected corresponding to a presence or non-presence of an operation of an exhaust brake and a magnitude of a supercharging pressure, and an amount of variation in an engine speed calculated based on a rotational variation frequency component.

6 Claims, 14 Drawing Sheets

METHOD FOR CORRECTING FUEL INJECTION AMOUNT IN COMMON-RAIL-TYPE FUEL INJECTION CONTROL DEVICE AND COMMON-RAIL-TYPE FUEL INJECTION CONTROL DEVICE

BACKGROUND OF THE INVENTION

The invention relates to a method for correcting a fuel injection amount in a common-rail-type fuel injection control device and a common-rail-type fuel injection control device, and more particularly to a method and a device which can realize the enhancement of correction accuracy or the like.

With respect to a fuel injection control for an internal combustion engine, various fuel injection amount correction techniques have been conventionally proposed for correcting the deviation between an actual fuel injection amount and a target fuel injection amount caused by irregularities of characteristics of a fuel injection valve, the deterioration of the fuel injection valve or the like.

For example, in a pilot injection control performed by a fuel injection control device which is configured to perform learning processing of a fuel injection amount, there has been proposed a technique where an amount of variation in an engine speed when injection for learning is performed and an amount of variation in an engine speed when injection for learning is not performed are detected, and a fuel injection amount which is expected to be actually injected (actual fuel injection amount) by a fuel injection valve is calculated based on detected amounts of variation in the engine speed, and the correction of fuel injection amount is performed using the difference between the actual fuel injection amount and a command fuel injection amount as a correction amount thus making the actual fuel injection amount agree with the command fuel injection amount (see JP-A-2005-36788).

To directly measure the actual fuel injection amount is difficult in actual measurement and hence, the technique which calculates the actual fuel injection amount based on a variation amount in an engine speed as described above is a method which is conventionally used since the method can relatively easily acquire the actual fuel injection amount.

As such a technique for acquiring a variation amount in an engine speed, for example, there has been known a technique where the injection of a minute injection amount is performed several times when a vehicle is in a so-called overrun state (non-injection state), and a variation in an engine speed in such a state is detected as a variation in a frequency component of an engine speed, and an actual injection amount is estimated based on the variation in a frequency component, and the correction of the fuel injection amount based on the technique is also performed.

With respect to a vehicle which uses an internal combustion engine represented by a diesel engine, there has been known a vehicle which includes an exhaust brake device which uses an exhaust gas. In such a vehicle, a cylinder internal pressure of an engine when fuel is not injected differs depending on the use or the non-use of the exhaust brake. The difference in such a cylinder internal pressure is small at a relatively low land. However, at a high land, in a case where the injection of minute injection amount is performed several times when the fuel is not injected as described above, a variation in an engine speed which occurs in such a state is detected as a variation in a frequency component of the engine speed, and the correction of fuel injection amount is performed by estimating an actual injection amount based on a variation in a frequency component, there arises a drawback that the difference in the cylinder internal pressure becomes so large that the correction error is induced whereby the difference in the cylinder internal pressure cannot be overlooked.

SUMMARY OF THE INVENTION

The invention has been made in view of the above, and it is an object of the invention to provide a method for correcting fuel injection amount in a common-rail-type fuel injection control device and a common-rail-type fuel injection control device which can overcome the error in correction of fuel injection amount caused by the use of an exhaust brake or the like and enables the more reliable correction of fuel injection amount.

According to a first aspect of the invention, there is provided a method for correcting fuel injection amount in a common-rail-type fuel injection control device where minute injection which is fuel injection of a minute injection amount is performed plural times when a fuel injection valve is in a non-injection state; an estimated injection amount which is estimated to be injected at the time of performing the minute injection is acquired based on an amount of variation in an engine speed generated in the minute injection; the difference between a reference energizing time corresponding to the estimated injection amount and a rail pressure at the time of performing the minute injection which is acquired from a reference energizing time map from which an energizing time acquired at the time of mounting the fuel injection valve with respect to various rail pressures and fuel injection amounts is readable as the reference energizing time using a rail pressure and a fuel injection amount as input parameters and an energizing time at the time of performing the minute injection is acquired, the difference between the reference energizing time and the energizing time at the time of performing the minute injection is stored as a learnt value in an updatable manner, and at the time of performing fuel injection subsequently, a value acquired by correcting the reference energizing time with the learnt value is set as an energizing time, whereby the deviation of a fuel injection amount caused by the deviation of an injection characteristic of the fuel injection valve is correctable, and the amount of variation in the engine speed is calculated based on a rotational variation frequency component which is an amount of variation in a frequency component of an engine rotation signal, wherein at the time of performing the minute injection, an energizing time acquired by correcting the reference energizing time with the learnt value is corrected corresponding to the presence or the non-presence of an operation of an exhaust brake and the magnitude of a supercharging pressure, and an amount of variation in the engine speed calculated based on the rotational variation frequency component is corrected corresponding to at least the presence or the non-presence of the operation of the exhaust brake and the magnitude of the supercharging pressure.

According to a second aspect of the invention, there is a common-rail-type fuel injection control device having an electronic control unit which executes an operation control of an internal combustion engine, the electronic control unit being configured such that minute injection which is fuel injection of a minute injection amount is performed plural times when a fuel injection valve is in a non-injection state; an estimated injection amount which is estimated to be injected at the time of performing the minute injection is calculated based on an amount of variation in an engine speed generated in the minute injection; the difference between a reference energizing time corresponding to the estimated injection amount and a rail pressure at the time of performing the minute injection which is acquired from a reference energizing time map from which an energizing time acquired at the time of mounting the fuel injection valve with respect to various rail pressures and fuel injection amounts is readable as the reference energizing time using a rail pressure and a fuel injection amount as input parameters and an energizing time at the time of performing the minute injection is calculated, a result of calculation of the difference is stored as a learnt value in an updatable manner, and at the time of performing fuel injection subsequently, a value acquired by correcting the reference energizing time with the learnt value is set as an energizing time, whereby the deviation of a fuel injection amount caused by the deviation of an injection characteristic of the fuel injection valve is correctable, and the amount of variation in the engine speed is calculated based on a rotational variation frequency component which is an amount of variation in a frequency component of an engine rotation signal, wherein the electronic control unit is configured such that, at the time of performing the minute injection, an energizing time acquired by correcting the reference energizing time with the learnt value is corrected corresponding to the presence or the non-presence of an operation of an exhaust brake and the magnitude of a supercharging pressure, and an amount of variation in the engine speed calculated based on the rotational variation frequency component is corrected corresponding to at least the presence or the non-presence of the operation of the exhaust brake and the magnitude of the supercharging pressure.

BRIEF DESCRIPTION OF THE DRAWINGS

FIG. 11A and FIG. 11B are schematic characteristic diagrams showing the summary of a variation in an amount of variation in rotation caused by the presence or the non-presence of the supercharging pressure correction, wherein FIG. 11A is a schematic characteristic curve chart showing the schematic correlation between a supercharging pressure and an amount of variation in rotation when the correction by the supercharging pressure is not performed, and FIG. 11B is a schematic characteristic curve chart showing the schematic correlation between the supercharging pressure and the amount of variation in rotation when the correction by the supercharging pressure is performed;

FIG. 12A and FIG. 12B are schematic characteristic curve charts showing the summary of a change in a threshold value of a correction value in the fuel injection amount correction by a supercharging pressure, wherein FIG. 12A is a schematic characteristic curve chart showing the schematic correlation between a supercharging pressure and an amount of variation in rotation when the threshold value is fixed, and FIG. 12B is a schematic characteristic curve chart showing the schematic correlation between the supercharging pressure and the amount of variation in rotation when the threshold value is changed corresponding to the supercharging pressure;

DETAILED DESCRIPTION

Hereinafter, a mode for carrying out the present invention is explained in conjunction with FIG. 1 to FIG. 14.

It will be noted that the members and arrangements described below are not intended to limit the invention and can be variously modified within the scope of the gist of the invention.

Figure 1:
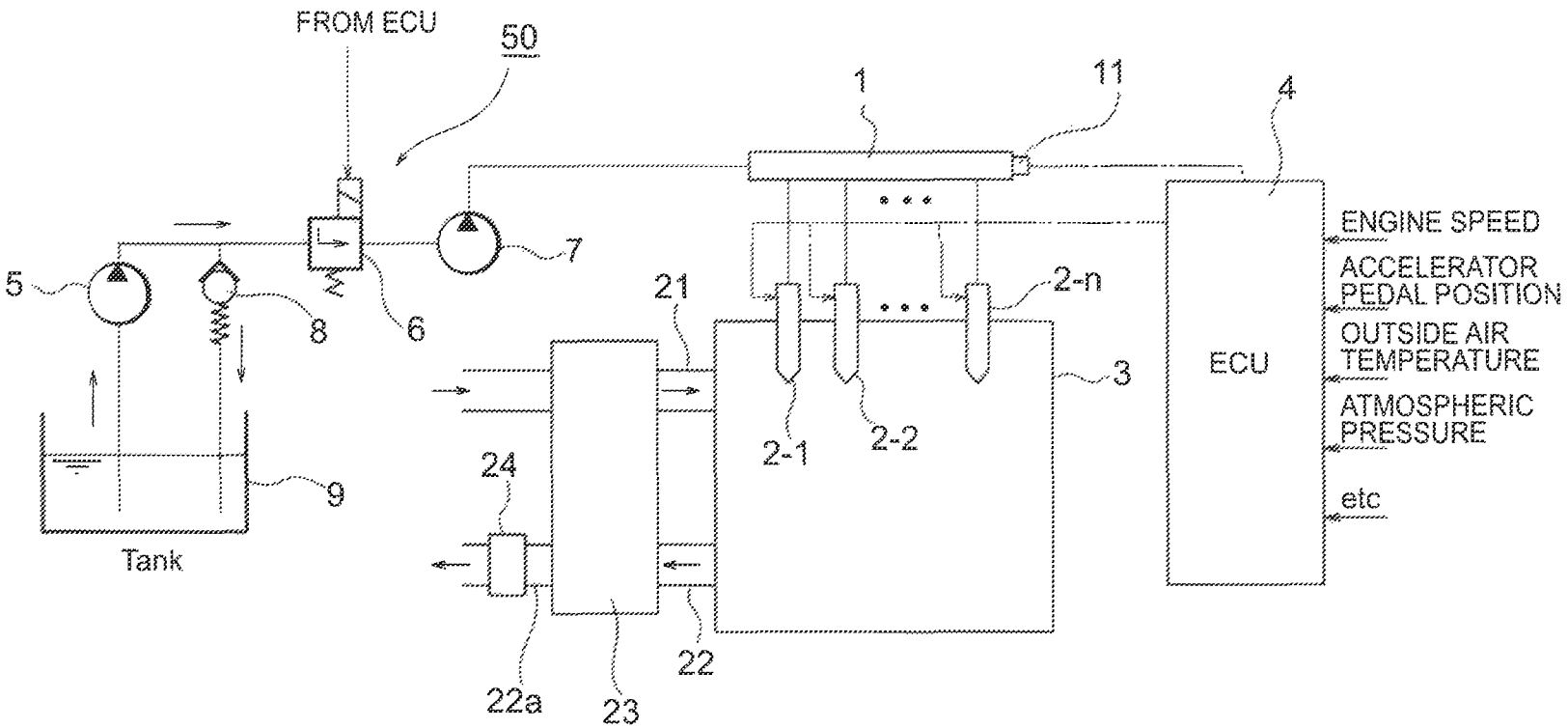
FIG. 1 is a constitutional view showing a constitutional example of a common-rail-type fuel injection control device to which a fuel injection amount correction method according to a mode for carry out the present invention is applied.

Firstly, one constitutional example of a fuel injection control device to which a fuel injection amount correction method according to the mode for carrying out the present invention is applied is explained in conjunction with FIG. 1.

The fuel injection control device according to the mode for carrying out the present invention is a so-called common-rail-type fuel injection control device. The common-rail-type fuel injection control device includes, as main constitutional elements thereof, a high pressure pump device 50 which supplies high pressure fuel under pressure, a common rail 1 which accumulates high pressure fuel supplied by the high pressure pump device 50 under pressure, plural fuel injection valves 2-1, . . . , **2-*n* which inject and supply high pressure fuel supplied from the common rail 1 to cylinders of a diesel engine (referred to as "engine" hereinafter) 3 which constitutes an internal combustion engine, and an electronic control unit (expressed as "ECU" in FIG. 1) 4** which executes fuel injection control processing, fuel injection amount correction processing described later and the like.

The above-mentioned constitution per se is equal to the basic constitution of this type of fuel injection control device which has been conventionally well-known.

The high pressure pump device 50 has the known or well-known constitution. That is, the high pressure pump device 50 includes, as main components thereof, a supply pump 5, a metering valve 6, and a high pressure pump 7.

In such a constitution, fuel in a fuel tank 9 is pumped up by the supply pump 5 and is supplied to the high pressure pump 7 through the metering valve 6. As the metering valve 6, an electromagnetic proportional control valve is used. Since an amount of electricity supplied to the metering valve 6 is controlled by the electronic control unit 4, a flow rate of fuel supplied to the high pressure pump 7, that is, a flow amount of fuel from the high pressure pump 7 is adjusted.

Here, a return valve 8 is arranged between an output side of the supply pump 5 and the fuel tank 9 so that surplus fuel on the output side of the supply pump 5 can be returned to the fuel tank 9.

Further, the supply pump 5 may be arranged on an upstream side of the high pressure pump device 50 separately from the high pressure pump device 50 or may be arranged in the inside of the fuel tank 9.

The fuel injection valves 2-1, . . . , **2-*n* are provided to cylinders of the engine 3 respectively. The fuel injection valves 2-1, . . . , 2-*n* respectively receive high pressure fuel from the common rail 1, and perform the fuel injection based on an injection control executed by the electronic control unit 4. The fuel injection valves 2-1, . . . , 2-*n*** used in the mode for carrying out the present invention are preferably formed of so-called electromagnetic-valve-type fuel injection valves which have been conventionally used, for example.

The electronic control unit 4 includes, for example, besides a micro computer (not shown in the drawing) having the known/well-known constitution as an essential part thereof, storage elements (not shown in the drawing) such as a RAM and a ROM. Further, the electronic control unit 4 includes, as main constitutional elements thereof, a circuit for driving the fuel injection valves 2-1, . . . , **2-*n* not shown in the drawing by energizing and, a circuit for driving the metering valve 6** and the like (not shown in the drawing) by energizing.

To the electronic control unit 4 having such a constitution, a detection signal of a pressure sensor 11 which detects a pressure in the conunon rail 1 is inputted. Further, various detection signals such as an engine speed, an accelerator pedal position, an outside air temperature, an atmospheric pressure, and a supercharging pressure are inputted to the electronic control unit 4 for controlling an operation of the engine 3 and for controlling the injection of fuel.

In the fuel injection control device according to the mode for carrying out the present invention, a super charger 23 is arranged between an intake manifold 21 and an exhaust manifold 22 of the engine 3 thus enabling the pressurizing of intake air.

Further, an exhaust shutter valve 24 is arranged at a proper position of in the middle of an exhaust pipe **22*a*. The exhaust shutter valve 24** can function as a so-called exhaust brake due to opening/closing thereof.

An operation control of the above-mentioned supercharger 23 and an operation control of an electromagnetic actuator (not shown in the drawing) for opening/closing the exhaust shutter valve 24 are also executed by the previously-described electronic control unit 4.

Figure 2:
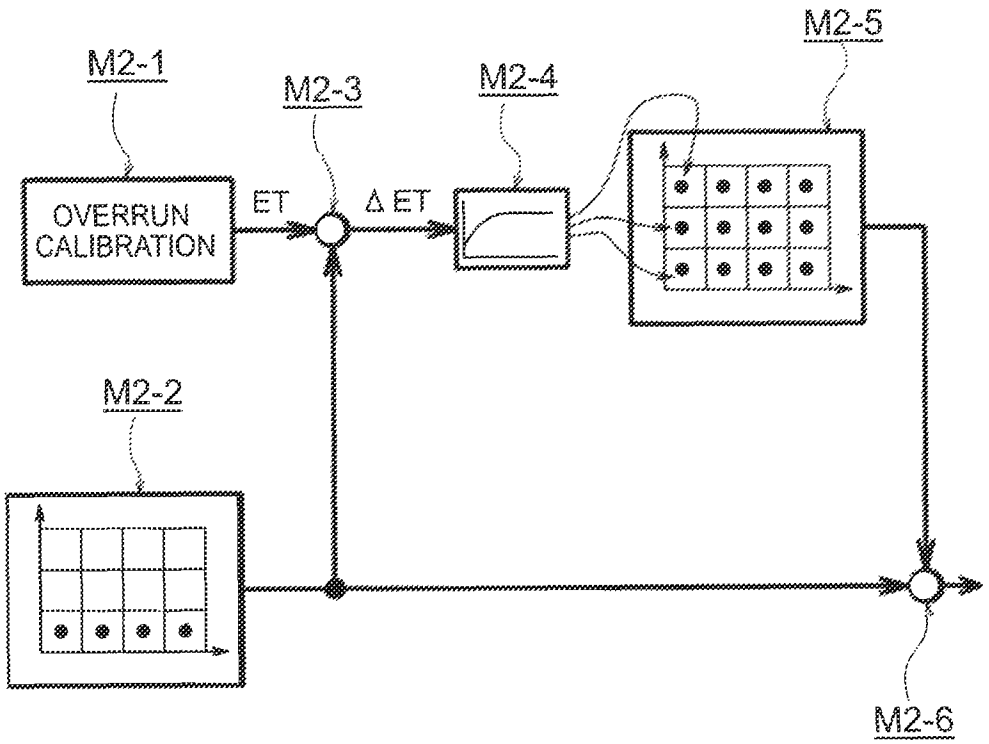
FIG. 2 is a schematic view for explaining the summary of a conventional fuel injection amount correction control which is used as a premise of the common-rail-type fuel injection control device to which the fuel injection amount correction method according to the mode for carrying out the present invention is applied.
Figure 3:
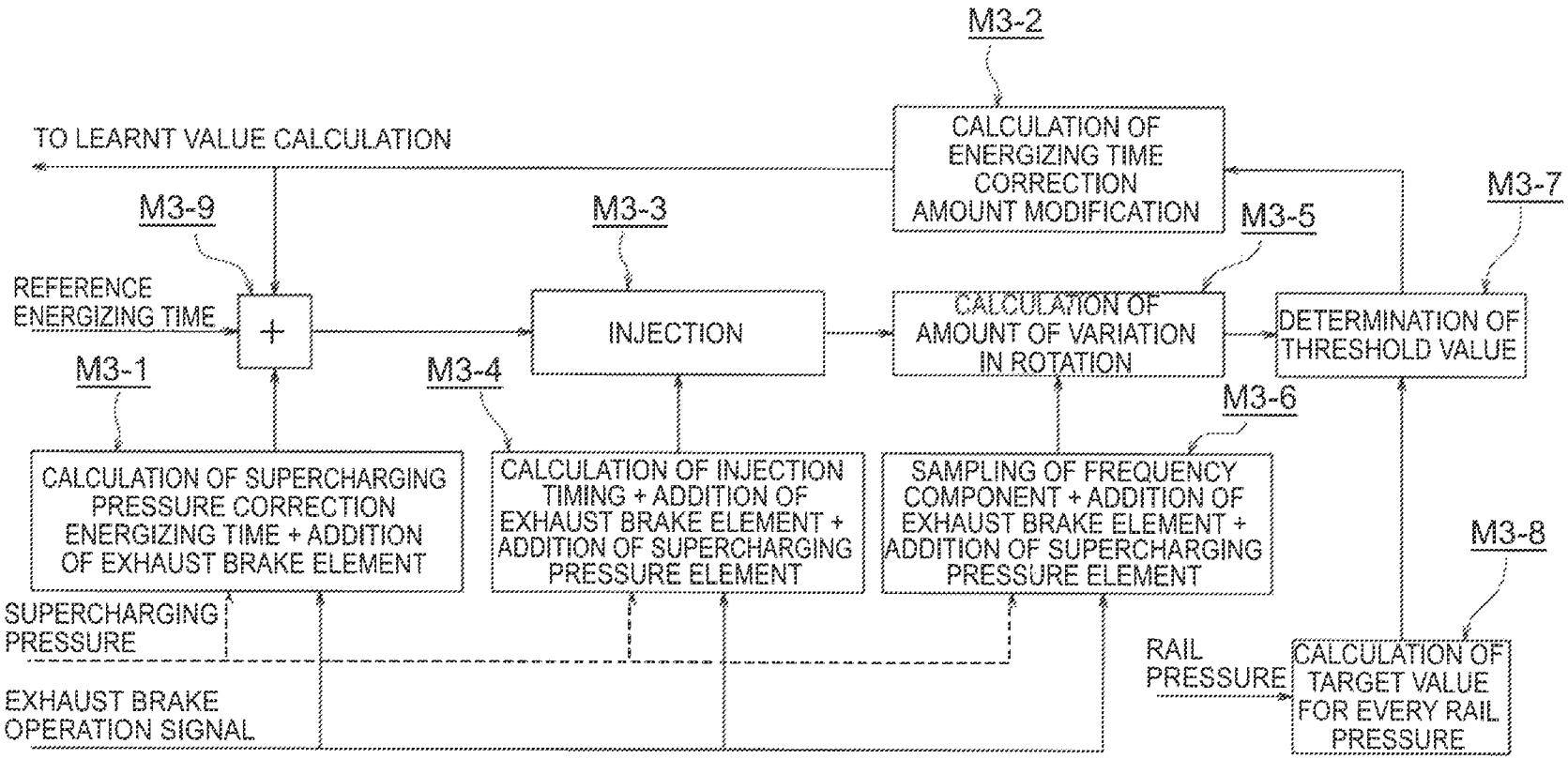
FIG. 3 is a schematic view which schematically shows, by functional blocks, functions necessary for an electronic control unit to execute fuel injection amount correction processing in a first embodiment of the mode for carrying out the present invention by the electronic control unit which constitutes the common-rail-type fuel injection control device shown in FIG. 1.
Figure 4:
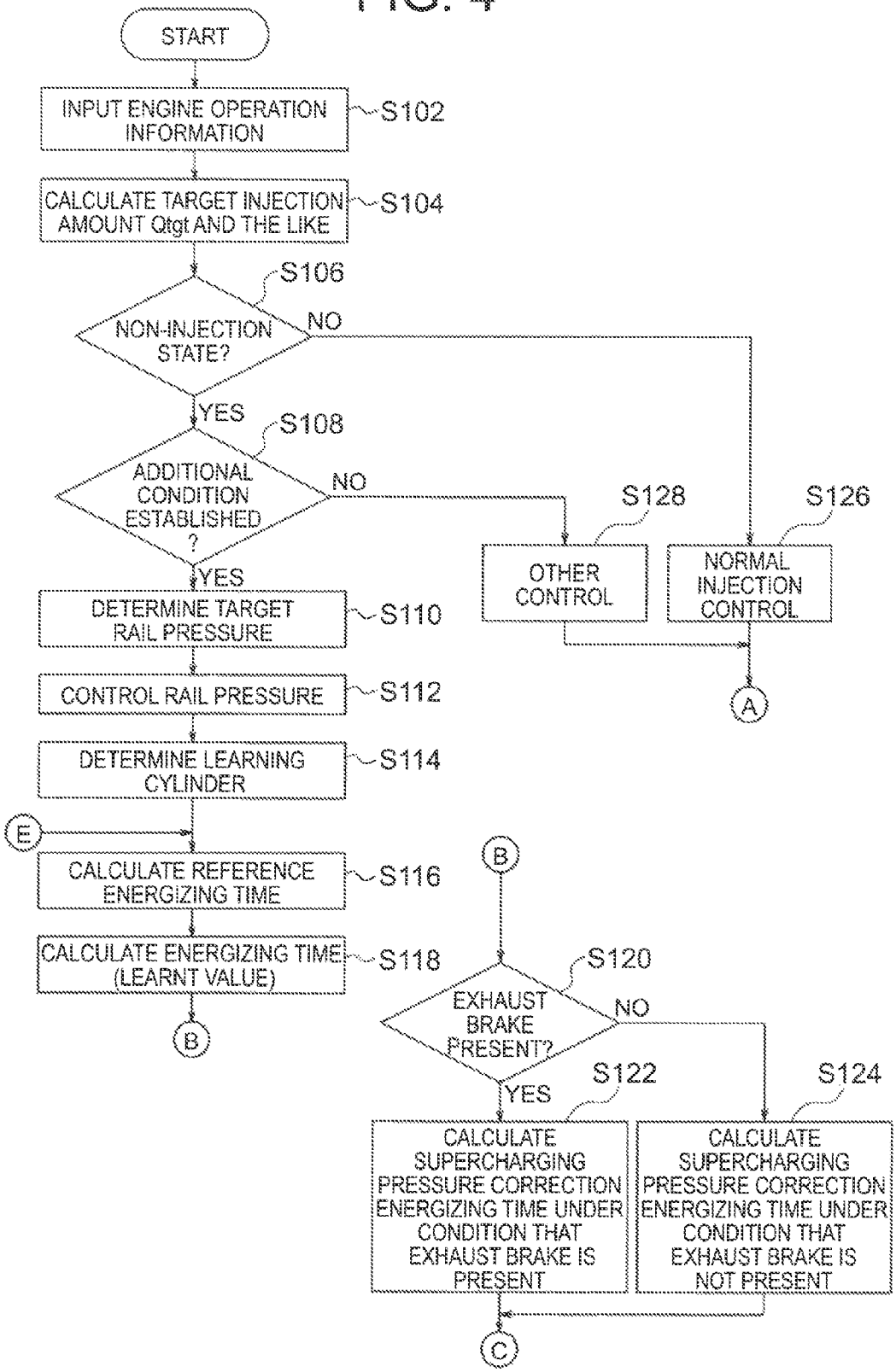
FIG. 4 is a flowchart of a sub routine showing steps of a front half portion of fuel injection amount correction processing in the first embodiment executed by the electronic control unit.

Next, a first embodiment of the fuel injection amount correction control processing executed by the electronic control unit 4 according to the mode for carrying out the present invention is explained in conjunction with FIG. 2 to FIG. 4.

Firstly, the common-rail-type fuel injection control device according to the mode for carrying out the present invention is configured on the premise that a fuel injection amount correction control described next is executed by the electronic control unit 4.

The fuel injection amount correction control which becomes the premise in the mode for carrying out the present invention has been executed also with respect to conventional devices. This control corrects, particularly, the deviation of a fuel injection amount from an original fuel injection amount in pilot injection and the deviation of injection timing which occur due to deterioration, defects or the like of the fuel injection valves 2-1, . . . , **2-*n***.

That is, to outline the fuel injection amount correction control, in this fuel injection amount correction control, firstly, when the engine 3 is in an overrun state (non-injection state), a minute injection amount corresponding to a rail pressure is set, the minute injection is performed approximately several ten times with such a minute injection amount, and a frequency component of a variation in an engine speed which is generated in performing the minute injection is sampled as an average value. Such processing is executed for every fuel injection valve 2-1, . . . , **2-*n***.

Next, an estimated value of an amount of fuel which is estimated to be injected actually (estimated injection amount) when the minute injection is performed is calculated based on the variation frequency component.

Then, when the estimated injection amount which is calculated first time exceeds a predetermined threshold value set for every rail pressure, the acquisition of an estimated injection amount is repeated while reducing a minute injection amount in the minute injection such that the estimated injection amount is lowered toward the predetermined threshold value and is substantially converged to the predetermined threshold value. On the other hand, when the estimated injection amount which is calculated first time is less than the predetermined threshold value set for every rail pressure, the acquisition of an estimated injection amount is repeated while increasing a minute injection amount in the minute injection such that the estimated injection amount is elevated toward the predetermined threshold value and is substantially converged to the predetermined threshold value. Then, the difference $\Delta ET$ between an energizing time ET required for acquiring an estimated injection amount which is converged to the predetermined threshold value and a reference energizing time is stored in an energizing time learnt value map as a differential energizing time learnt value.

Here, the reference energizing time is an energizing time at a point of time where the use of the respective fuel injection valves 2-1, . . . , **2-*n* is started. In other words, the reference energizing time is an energizing time which is actually measured immediately before the use of the fuel injection valves 2-1, . . . , 2-*n* is started, and an energizing time corresponding to a rail pressure and a fuel injection amount is mapped (referred to as "reference energizing time map" for facilitating the explanation hereinafter) for every fuel injection valve 2-1, . . . , 2-*n* and is stored in the electronic control unit 4** in advance.

In performing the fuel injection with a fuel injection amount at which the differential energizing time learnt value ΔET is acquired, a time which is acquired by correcting the reference energizing time with the differential energizing time learnt value ΔET is used as an energizing time so that the deviation between the fuel injection amount and the energizing time can be corrected. Hereinafter, for facilitating the explanation, an energizing time which is acquired by correcting the reference energizing time with a differential energizing time learnt value ΔET is referred to as "energizing time learnt value".

FIG. 2 is a schematic view showing the above-mentioned fuel injection mount correction control schematically. The explanation is made hereinafter in conjunction with FIG. 2.

In FIG. 2, a part which is expressed as "overrun calibration" and is given with symbol M2-1 schematically expresses a series of processing of calculating an energizing time ET required for acquiring an estimated injection amount which is converged to the predetermined threshold value from a point of time where the minute injection is started as explained previously.

Further, in FIG. 2, a part which is given with symbol M2-2 schematically expresses the reference energizing time map. The reference energizing time map stores energizing times (reference energizing times) which are actually measured immediately before the fuel injection valves 2-1, . . . , **2-*n* are used. That is, the reference energizing time corresponding to a rail pressure and a fuel injection amount is mapped for every fuel injection valve 2-1, . . . , 2-*n*** in the reference energizing time map.

With respect to the reference energizing time which is read from the reference energizing time map and the above-mentioned energizing time ET, the difference ΔET is acquired by performing subtraction processing (part which is given with symbol M2-3 in FIG. 2).

Then, out of the differences ΔET which are acquired as described above, only the difference ΔET which falls within a predetermined limited range (see symbol M2-4) is written in a normal time learnt value map which is given with symbol M2-5 as a differential energizing time learnt value ΔET.

After the learnt value is acquired, the energizing time corresponding to a target rail pressure and a fuel injection amount becomes the energizing time which is acquired by correcting the reference energizing time with the learnt value. That is, the energizing time corresponding to the target rail pressure and the fuel injection amount becomes the energizing time which is the result of addition of the reference energizing time and the differential energizing time learnt value ΔET (see symbol M2-6 in FIG. 2) so that the deviation of the energizing time and the deviation of the fuel injection amount which are generated by the deterioration of the fuel injection valves 2-1, . . . , **2-*n*** or the like can be corrected.

The differential energizing time learnt value ΔET per se can take both a positive value and a negative value. Accordingly, when the differential energizing time learnt value ΔET per se takes a positive value, the reference energizing time+the differential energizing time learnt value ΔET becomes adding processing actually, while when the differential energizing time learnt value ΔET per se takes a negative value, the reference energizing time+the differential energizing time learnt value ΔET becomes subtraction processing actually.

Next, a first embodiment of the fuel injection amount correction control in the mode for carrying out the present invention is schematically explained. The first embodiment is characterized in that based on the above-mentioned fuel injection amount correction control, particularly, in view of worsening of accuracy of fuel injection amount correction caused by a phenomenon that the presence or the non-presence of an exhaust brake induces a change in cylinder internal pressure in an overrun state, to enhance accuracy of fuel injection amount correction, unique control processing is added to a conventional fuel injection amount correction control.

FIG. 3 schematically shows the summary of fuel injection amount correction control processing in the first embodiment executed by the electronic control unit 4 using functional blocks, and the content of the fuel injection amount correction control processing is explained in conjunction with the drawing hereinafter.

Firstly, based on the conventional fuel injection amount control processing, the reference energizing time is acquired at the time of performing injection of minute injection amount in an overrun state (non-injection state). The reference energizing time can be acquired from the reference energizing time map which is explained in conjunction with FIG. 2 previously and to which symbol M2-2 is given. The reference energizing time is preliminarily stored in the electronic control unit 4.

In the reference energizing time map, as has been explained in conjunction with FIG. 2, the reference energizing time corresponding to a rail pressure and a fuel injection amount is mapped for every fuel injection valve 2-1, . . . **2-*n***. That is, the reference energizing time map is configured such that a target rail pressure and a fuel injection amount at the time of performing the fuel injection are inputted to the reference energizing time map, and the reference energizing time corresponding to the target rail pressure and the fuel injection amount can be read from the reference energizing time map.

For this reference energizing time, a correction time which takes into account the magnitude of a supercharging pressure generated by a super charger 23 and the presence or the non-presence of an operation of an exhaust brake is calculated based on a predetermined correction time calculation formula, and the correction time is added to the reference energizing time (see symbol M3-1 and M3-9 in FIG. 3). Further, a calculation result of the energizing time correction amount modification calculation described later is added to such an addition result by feedback (see symbol M3-2 in FIG. 3).

When the energizing time is acquired in the above-mentioned manner, the fuel injection is performed in accordance with such energizing time (see symbol M3-3 in FIG. 3). In this case, the injection timing is calculated by applying the correction which takes into account the presence or the non-presence of an operation of the exhaust brake and the supercharging pressure to conventional injection timing (see symbol M3-4 in FIG. 3).

The fuel injection is performed approximately preset several ten times with a minute injection amount, an amount of variation in rotational speed of the engine 3 which is generated in each fuel injection is sampled as a frequency component, and an estimated value of an injection amount (estimated injection amount) in the fuel injection is calculated based on the sampled frequency component (see symbol M3-5 in FIG. 3).

That is, variation frequency component sampling processing where an engine speed signal inputted to the electronic control unit 4 is made to pass through a band pass filter by software processing so that a frequency component corresponding to only an amount of variation in an engine speed is sampled is performed.

In the mode for carrying out the present invention, at the time of executing the variation frequency component sampling processing, the variation frequency component is corrected by taking into account the influence exerted on an amount of variation in the engine speed by the presence or the non-presence of an operation of an exhaust brake and the magnitude of the supercharging pressure (see symbol M3-6 in FIG. 3). In M3-6 in FIG. 3, the variation frequency component sampling processing is expressed as "frequency component sampling".

Next, based on the frequency component corresponding to an amount of variation in the engine speed acquired as described above, an estimated value of an injection amount (estimated injection amount) in the fuel injection is calculated. Here, a modification calculation of a correction amount of energizing time and feedback are performed such that an estimated injection amount is converged to a predetermined threshold value set for every rail pressure (see symbol M3-7 and symbol M3-8 in FIG. 3) (see symbol M3-2 and M3-9 in FIG. 3), and the calculation of estimated injection amount is repeated until the estimated injection amount is converged to the predetermined threshold value.

Then, when the estimated injection amount is converged to the predetermined threshold value, it is determined that learning processing is possible, and the difference ΔET between the energizing time ET required for acquiring the estimated injection amount and the reference energizing time is stored in the energizing time learnt value map as the differential energizing time learnt value as explained in conjunction with FIG. 2 previously.

Figure 5:
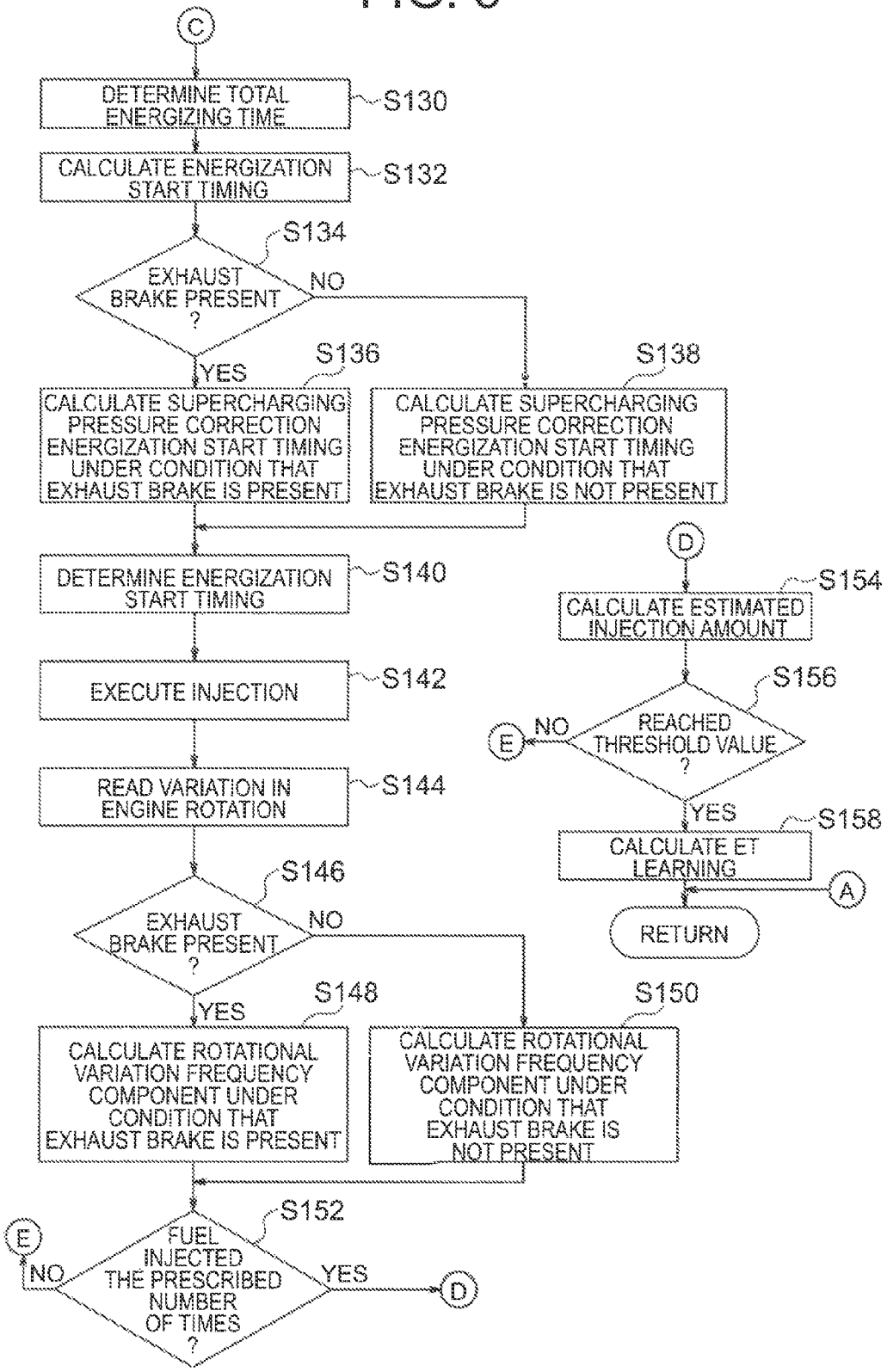
FIG. 5 is a flowchart of the sub routine showing steps of a latter half portion of fuel injection amount correction processing in the first embodiment executed by the electronic control unit.

Next, the more specific steps of the above-mentioned fuel injection amount correction processing executed by the electronic control unit 4 are explained in conjunction with FIG. 4 and FIG. 5.

When the processing by the electronic control unit 4 is started, various operation information indicative of an operation state of the engine 3 is firstly inputted to the electronic control unit (see step S102 in FIG. 4).

That is, an engine speed Ne, an accelerator pedal position Acc and the like which are detected by sensors not shown in the drawing or the like are suitably inputted to the electronic control unit 4 as engine operation information.

Next, based on the above-mentioned engine operation information, a target fuel injection amount Qtgt necessary for a fuel injection control or the like is calculated (see step S104 in FIG. 4). Then, it is determined whether or not an operation state of the engine 3 is a non-injection state (overrun state) (see step S106 in FIG. 4).

When it is determined that the operation state of the engine 3 is the non-injection state (when the determination is affirmative) in step S106, the processing advances to processing in step S108 described later, while when it is determined that the operation state of the engine 3 is not the non-injection state (when the determination is negative), it is determined that the operation state of the engine 3 is not a state suitable for performing the fuel injection amount correction, and a usual injection control is executed (see step S126 in FIG. 4) and, thereafter, the processing returns to a main routine not shown in the drawing once.

On the other hand, in step S108, it is determined whether or not a predetermined addition condition which is further necessary in addition to the non-injection state for performing a fuel injection amount correction control is established. When it is determined that the addition condition is established (when the determination is affirmative), the processing advances to processing in step S110 described later. On the other hand, when it is determined that the addition condition is not established (when the determination is negative), it is determined that the operation state of the engine 3 is not a state suitable for performing the fuel injection amount correction, and another required control is executed (see step S128 in FIG. 4) and, thereafter, the processing returns to the main routine not shown in the drawing once.

The addition condition is to be suitably selected corresponding to specific conditions of an individual vehicle, and is not limited to particular conditions.

In step S110, a target rail pressure is determined by arithmetic processing in the same manner as a usual control. Subsequently, a rail pressure control is executed such that the target rail pressure can be acquired (see step S112 in FIG. 4).

Next, a cylinder which becomes an object to be processed by fuel injection amount correction based on learning processing (learning cylinder) is specified (see step S114 in FIG. 4).

That is, the fuel injection amount correction control which is performed in processing in step S116 and succeeding steps by taking into account the presence or the non-presence of an exhaust brake and the influence of a supercharging pressure is sequentially performed with respect to the respective cylinders, and information on which cylinder is subjected to processing in step S116 and steps succeeding step S116 is constantly stored in a suitable memory area of the electronic control unit 4. In step S114, a cylinder which becomes a next object to be processed is specified based on a cylinder which becomes an immediately preceding object to be processed stored in the suitable memory area of the electronic control unit 4.

Next, the reference energizing time corresponding to the target rail pressure and the fuel injection amount at this point of time is read from the reference energizing time map (see step S116 in FIG. 4).

Subsequent to step S116, the energizing time calculation using a learnt value is performed (see step S118 in FIG. 4). That is, the energizing time is calculated in such a manner that a differential energizing time learnt value ΔET corresponding to the target rail pressure and the fuel injection amount determined in step S112 is read from the energizing time learning map (see symbol M2-5 in FIG. 2), and the differential energizing time learnt value ΔET is added to the reference energizing time.

Then, it is determined whether or not the exhaust brake is in an operation state (see step S120 in FIG. 4). When it is determined that the exhaust brake operation is underway (when the determination is affirmative), the processing advances to processing in step S122 described next. On the other hand, when it is determined that the exhaust brake operation is not underway (when the determination is negative), the processing advances to processing in step S124 described later.

In step S122, the energizing time which is calculated in proceeding step S118 is corrected using a predetermined correction formula by taking into account the fact that the exhaust brake operation is underway and the magnitude of a supercharging pressure. The predetermined correction formula is set based on a result of a test, a result of simulation or the like. As a specific method of correcting the energizing time by taking into account the fact that the exhaust brake operation is underway or the magnitude of the supercharging pressure, various methods can be taken including, for example, a method where a coefficient corresponding to a state that the exhaust brake operation is underway and a coefficient corresponding to the magnitude of the supercharging pressure are set respectively, and the energizing time calculated in step S118 is multiplied by these coefficients or added with these coefficients. However, with respect to a method to be adopted, it is preferable to select the proper method based on the result of the test, the result of simulation or the like by taking into account specific conditions or the like of a vehicle.

On the other hand, in step S124, the energizing time calculated in preceding step S118 is corrected using a predetermined correction formula by taking into account the fact that the exhaust brake operation is not underway and the magnitude of a supercharging pressure. The predetermined correction formula is set based on a result of a test, a result of a simulation or the like. The specific correction method may be considered substantially equal to the correction method exemplified in conjunction with the above-mentioned step S122.

When either the processing in the above-mentioned step S112 or the processing in the above-mentioned step S124 is executed, the total energizing time, that is, the final energizing time corresponding to the presence or the non-presence of an operation of the exhaust brake or the like is determined (see step S130 in FIG. 5).

Then, energizing start timing is calculated using a predetermined calculation formula based on an engine speed and a target rail pressure (see step S132 in FIG. 5).

The energizing start timing calculated in step S132 is also referred to as a so-called standard value under a standard operation condition where the presence or the non-presence of the exhaust brake or the like is not taken into account.

Next, it is determined whether or not the exhaust brake is in an operation state again (see step S134 in FIG. 5). When it is determined that the exhaust brake operation is underway (when the determination is affirmative), usually, the energizing start timing determined based on an engine speed and a target rail pressure is corrected by a predetermined correction formula by taking into account that the exhaust brake operation is underway and the magnitude of a supercharging pressure, and the energizing start timing after correction is referred to as the correction energizing start timing with the exhaust brake and with the supercharging pressure (see step S136 in FIG. 5). The predetermined correction formula is set based on a result of a test, a result of simulation or the like.

On the other hand, when it is determined that the exhaust brake operation is not underway in step S134 (when the determination is negative), usually, the energizing start timing which is determined based on an engine speed and a target rail pressure is corrected by a predetermined correction formula by taking into account that the exhaust brake operation is not underway and the magnitude of a supercharging pressure, and the energizing start timing after correction is referred to as correction energizing start timing with no exhaust brake and with a supercharging pressure (see step S138 in FIG. 5).

The reason that the correction of the energizing start timing is performed in this manner is that even when the magnitude of a supercharging pressure is equal, a cylinder internal pressure differs depending on the presence or the non-presence of an operation of the exhaust brake, and the correction of the energizing start timing can suppress the deviation of timing of ignition caused by the difference in the cylinder internal pressure. As the overall tendency, there exists a tendency that the cylinder internal pressure is elevated when the exhaust brake operation is underway compared to a case where the exhaust brake operation is not underway.

By executing the processing in step S136 or the processing in step S138 as described above, the final energizing start timing is determined (see step S140 in FIG. 5), and the fuel injection is performed to the cylinder specified in preceding step S114 at this determined energizing start timing for the energizing time determined in preceding step S130 (see step S142 in FIG. 5).

In such a state, reading of a variation in an engine speed caused by performing the fuel injection is performed (see step S144 in FIG. 5).

Next, it is determined whether or not the exhaust brake operation is underway (see step S146 in FIG. 5). When it is determined that the exhaust brake operation is underway (when the determination is affirmative), the processing advances to processing in step S148 described next, while when it is determined that the exhaust brake operation is not underway (when the determination is negative), the processing advances to processing in step S150 described later.

In step S148, a frequency component corresponding to an amount of variation in rotation (rotation variation frequency component) is calculated based on the amount of variation in engine rotation which is acquired in preceding step S144 by making the amount of variation in engine rotation pass through a band pass filter by software processing in the electronic control unit 4 as described previously. In this step, in executing such calculation, the frequency component is calculated with correction by taking into account, at least, that the exhaust brake operation is underway, the magnitude of a supercharging pressure and setting of gears.

On the other hand, in step S150, a frequency component corresponding to an amount of variation in rotation (rotation variation frequency component) is calculated based on an amount of variation in an engine speed which is acquired in preceding step S144 by making the amount of variation in engine rotation pass through a band pass filter by software processing in the electronic control unit 4 as described previously. In this step S150, the frequency component is calculated with correction by taking into account, at least, that the exhaust brake operation is not underway, the magnitude of a supercharging pressure and setting of gears.

With respect to a specific method for correcting the rotation variation frequency component by taking into account the presence or the non-presence of an operation of the exhaust brake, the magnitude of a supercharging pressure and setting of gears, it is preferable to select a proper method based on a result of a test, a result of simulation or the like by taking into account various specific conditions of a vehicle.

After the processing in step S148 or the processing in S150 is executed as described above, it is determined whether or not the number of times of injection reaches the prescribed number of times (see step S152 in FIG. 5). When it is determined that the number of times of injection does not reach the prescribed number of times (when the determination is negative), the processing returns to the processing in preceding step S116 (see FIG. 4), and the similar processing is repeated. On the other hand, when it is determined that the number of times of injection reaches the prescribed number of times (when the determination is affirmative), the processing advances to processing in step S154 described next.

In step S154, an estimated injection amount is calculated based on the rotation variation frequency component corresponding to the amount of variation in engine rotation acquired in step S148 or in step S150.

That is, an estimated injection amount in the fuel injection which is performed the prescribed number of times during the processing ranging from the preceding step S116 to step S152 (see FIG. 4 and FIG. 5) is calculated as an average value.

Next, it is determined whether or not the estimated injection amount acquired in step S154 is converged to a preset reference injection amount (threshold value) (see step S156 in FIG. 5).

Here, the determination of whether or not the estimated injection amount is converged to the preset threshold value is performed by determining whether or not the estimated injection amount passes the predetermined threshold value in the mode for carrying out the present invention.

To be more specific, firstly, with respect to a case where the calculation of the estimated injection amount performed in step S154 is the calculation performed first time, usually, it is considered that the estimated injection amount hardly agrees with the predetermined threshold value from the first time. That is, it is considered that the estimated injection amount is below the predetermined threshold value or above the threshold value. In this case, it is determined that the estimated injection amount is not converged to the predetermined threshold value (the determination being negative), and the processing returns to processing in preceding step S116 (see FIG. 4).

The predetermined reference injection amount (threshold value) is determined for every fuel injection valve 2-1, . . . **2-*n* (in other words, for every cylinder) and for every rail pressure. In the mode for carrying out the present invention, the predetermined reference injection amount is calculated and set by a preset reference injection amount calculation formula based on a rail pressure at a point of time that processing in step S156 is executed (see symbol M3-8 in FIG. 3**). The reference injection amount calculation formula is provided for calculating the proper reference injection amount (threshold value) using a rail pressure as a variable, and is set based on a result of a test, a result of a simulation or the like.

The proper reference injection amount (threshold value) is determined with reference to the allowable degree of deviation with respect to the relative relation which is to be originally established between the energizing time of each fuel injection valve 2-1, . . . , **2-*n*** and the fuel injection amount.

Then, the processing returns to the processing in step S116, and a series of processing explained previously is repeated again. In this case, in the processing in step S122 or in step S124, corresponding to the result of the determination made in step S156 described above, the energizing time is modified such that the estimated injection amount approaches the predetermined threshold value. As the result, after the processing in step S116 and succeeding steps are repeated plural times, when the estimated injection amount is below the predetermined threshold value initially, the estimated injection amount eventually becomes larger than the predetermined threshold value, and while when the estimated injection amount is above the predetermined threshold value initially, the estimated injection amount eventually becomes lower than the predetermined threshold value. Accordingly, in step S156, it is determined that the estimated injection amount passes the predetermined threshold value, that is, the estimated injection amount is converged to the predetermined threshold value.

In step S156, when it is determined that the estimated injection amount is converged to the predetermined threshold value (when the determination is affirmative), it is determined that learning of the energizing time is possible, and the processing advances to processing in step S158 described next.

The determination of whether or not the estimated injection amount is converged to the predetermined threshold value is not always limited to a mode where the determination is made based on whether or not the estimated injection amount passes the predetermined threshold value once as described above. For example, the determination is preferably made by determining whether or not the estimated injection amount falls within an allowable range with the predetermined threshold value set at the center. That is, the determination is also preferably made such that a predetermined lower limit value ($-\alpha$) and a predetermined upper limit value ($+\alpha$) are set with the predetermined threshold value at the center, and it is determined that the estimated injection amount is converged to the predetermined threshold value when the estimated injection amount falls within this allowable range from an initial state where the estimated injection amount falls outside the allowable range, in other words, when the estimated injection amount is elevated from a value below the predetermined lower limit value and passes the predetermined lower limit value (becoming larger than the predetermined lower limit value) or when the estimated injection amount is lowered from a value above the predetermined upper limit value and passes the predetermined upper limit value (becoming smaller than the predetermined upper limit value).

When it is determined that the estimated injection amount is converged to the predetermined threshold value in step S156 as described above, the energizing time learning calculation is performed (see step S158 in FIG. 5).

That is, the difference $\Delta ET$ between the total energizing time determined in preceding step S130 and the reference energizing time (see symbol M2-2 in FIG. 2) is stored in the energizing time learnt value map (see M2-5 in FIG. 2) as a differential energizing time learnt value using the fuel injection amount, that is, the precedingly acquired estimated injection amount and a rail pressure at this point of time as parameters. Thereafter, the processing once returns to the main routine not shown in the drawing.

Next, a second embodiment is explained in conjunction with FIG. 6 to FIG. 12.

In the preceding first embodiment, worsening of the correction accuracy of the fuel injection amount correction control caused by the use of the exhaust brake can be suppressed. In the second embodiment, worsening of the correction accuracy of a fuel injection amount correction control when a vehicle is at a high land can be suppressed.

A fuel injection control device applied to a fuel injection amount control method of the second embodiment is also constituted on the premise of the common-rail-type fuel control device having the constitution shown in FIG. 1 in the same manner as the preceding first embodiment.

Figure 6:
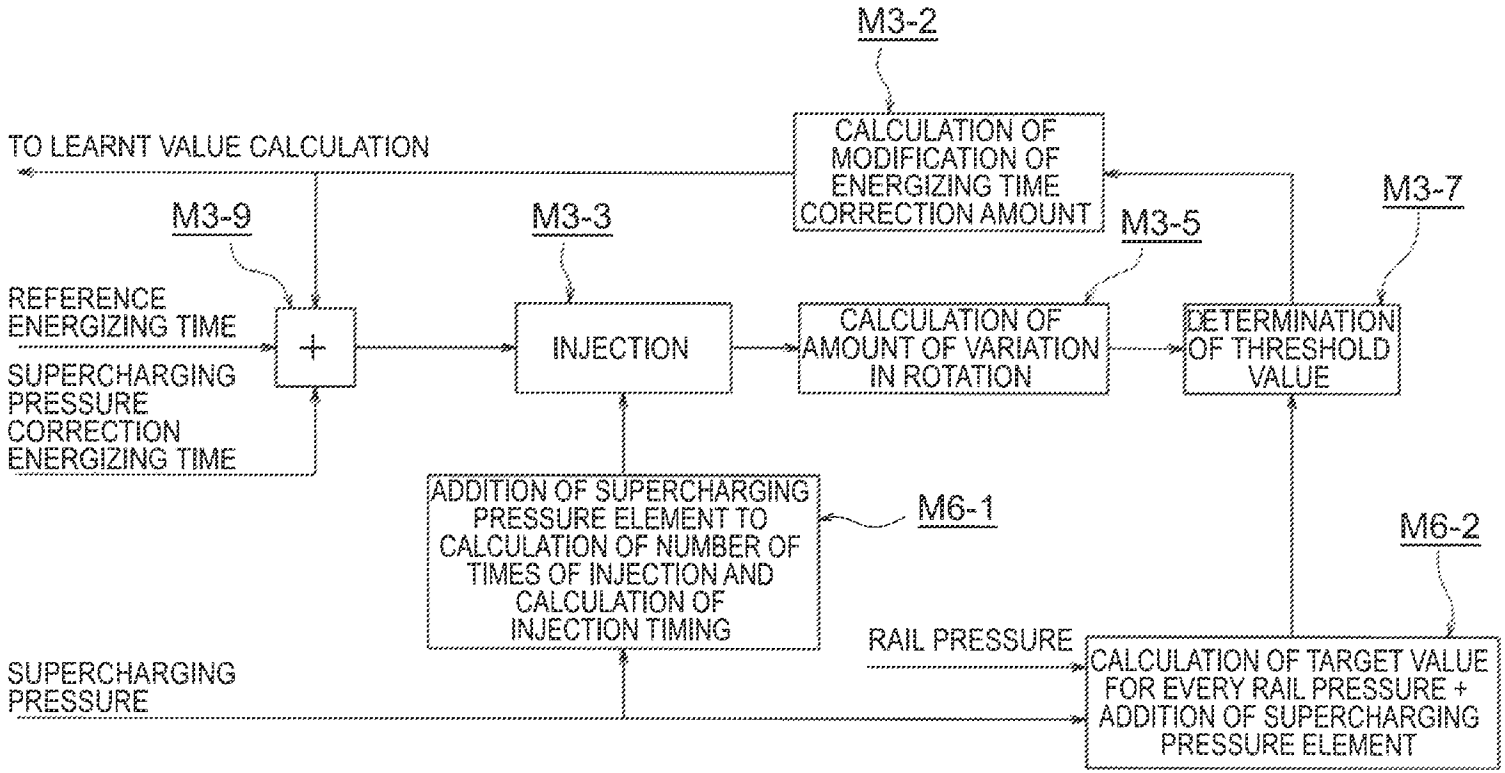
FIG. 6 is a schematic view which schematically shows, by functional blocks, functions necessary for an electronic control unit to execute fuel injection amount correction processing in a second embodiment of the mode for carrying out the present invention by the electronic control unit which constitutes the common-rail-type fuel injection control device shown in FIG. 1.

FIG. 6 schematically shows the summary of fuel injection amount correction control processing in the second embodiment executed by an electronic control unit 4 by functional blocks. Hereinafter, the content of the fuel injection amount correction control processing is explained in conjunction with the drawing.

The functional blocks identical with the functional blocks shown in FIG. 3 previously are given the same symbols, and the detailed explanation of these functional blocks is omitted, and the explanation is made by focusing on points which make this embodiment different from the first embodiment hereinafter.

Firstly, the reference energizing time is acquired at the time of performing injection of minute injection amount in an overrun state (non-injection state). The reference energizing time can be acquired from the reference energizing time map which is explained in conjunction with FIG. 2 previously and to which symbol M2-2 is given. The reference energizing time is stored in the electronic control unit 4 in advance.

In the reference energizing time map, as has been explained in conjunction with FIG. 2, the reference energizing time corresponding to a rail pressure and a fuel injection amount is mapped for every fuel injection valve 2-1, . . . **2-*n*. That is, the reference energizing time map is configured such that, a target rail pressure and a fuel injection amount used at the time of performing the fuel injection are inputted to the electronic control unit 4**, and the reference energizing time corresponding to the target rail pressure and the fuel injection amount can be read out.

For this reference energizing time, a supercharging pressure correction energizing time which takes into account the magnitude of a supercharging pressure generated by a super charger 23 is calculated using a predetermined correction time calculation formula, and the supercharging pressure correction energizing time is added to the reference energizing time (see symbol M3-9 in FIG. 6).

Further, a calculation result of the energizing time correction amount modification calculation described later is added to such an addition result by feedback (see symbol M3-2 in FIG. 6).

On the other hand, the number of times of injection and the injection timing are acquired using predetermined calculation formulae by taking into account the magnitude of a supercharging pressure (see symbol M6-1 in FIG. 6), and the injection is performed the calculated number of times at calculated timing for previously acquired energizing time (see symbol M3-3 in FIG. 6).

Figure 11A:
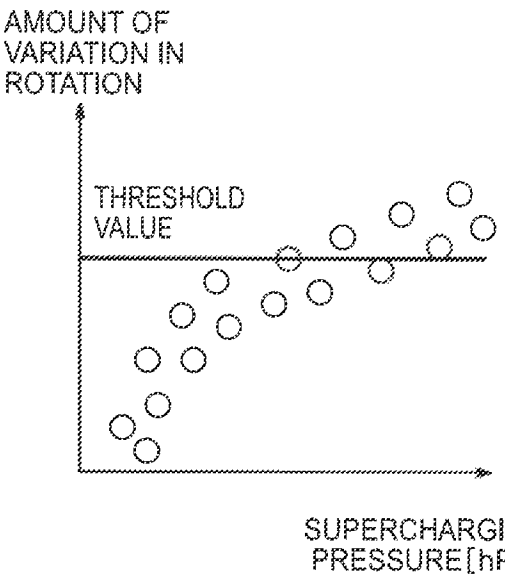
Figure 11B:
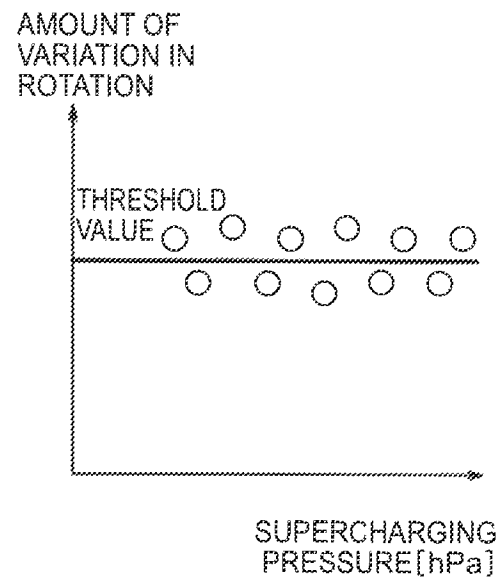

The reason that the supercharging pressure is taken into account with respect to the number of times of injection and the injection timing is that while the amount of variation in rotational is changed corresponding to the magnitude of the supercharging pressure in a conventional control which does not take into account the supercharging pressure as shown in FIG. 11A, the substantially fixed amount of variation in an engine speed can be acquired by taking into account the supercharging pressure as shown in FIG. 11B irrespective of the magnitude of the supercharging pressure.

The fuel injection is performed approximately preset several ten times with a minute injection amount, an amount of variation in an engine speed of the engine 3 which is generated in each fuel injection is sampled as a frequency component, and an estimated value of an injection amount (estimated injection amount) in the fuel injection is calculated based on the sampled frequency component (see symbol M3-5 in FIG. 6).

That is, variation frequency component sampling processing where an engine speed signal inputted to the electronic control unit 4 is made to pass through a band pass filter by software processing so that a frequency component corresponding to only an amount of variation in the engine speed is sampled is performed.

Next, based on the frequency component corresponding to an amount of variation in the engine speed acquired as described above, an estimated value of injection amount (estimated injection amount) in the fuel injection is calculated. Here, a modification calculation of a correction amount of energizing time and feedback are performed such that the estimated injection amount is converged to a predetermined threshold value set for every rail pressure (see symbol M3-7 and symbol M6-2 in FIG. 6) (see symbol M3-2 and M3-9 in FIG. 6), and the calculation of estimated injection amount is repeated until the estimated injection amount is converged to the predetermined threshold value.

Then, when the estimated injection amount is converged to the predetermined threshold value, it is determined that learning processing is possible, and the energizing time required for acquiring the estimated injection amount is served for learnt value calculation processing.

That is, as explained in conjunction with FIG. 2 previously, the difference ΔET between the energizing time required for acquiring the estimated injection amount and the reference energizing time is acquired, and the calculated difference ΔET is stored in an energizing time learnt value map as the differential energizing time learnt value (see symbol M2-5 in FIG. 2).

Here, the above-mentioned threshold value which becomes the reference for determination of whether or not the estimated injection amount reaches a value suitable for performing learning processing of an energizing time is decided using a preset calculation formula for every rail pressure (see symbol M6-2 in FIG. 6). This calculation formula is decided based on a result of test, a result of a simulation or the like. Particularly, the calculation formula is decided by taking into account the magnitude of a supercharging pressure. Accordingly, an error in a threshold value at a high land can be suppressed.

Figure 10:
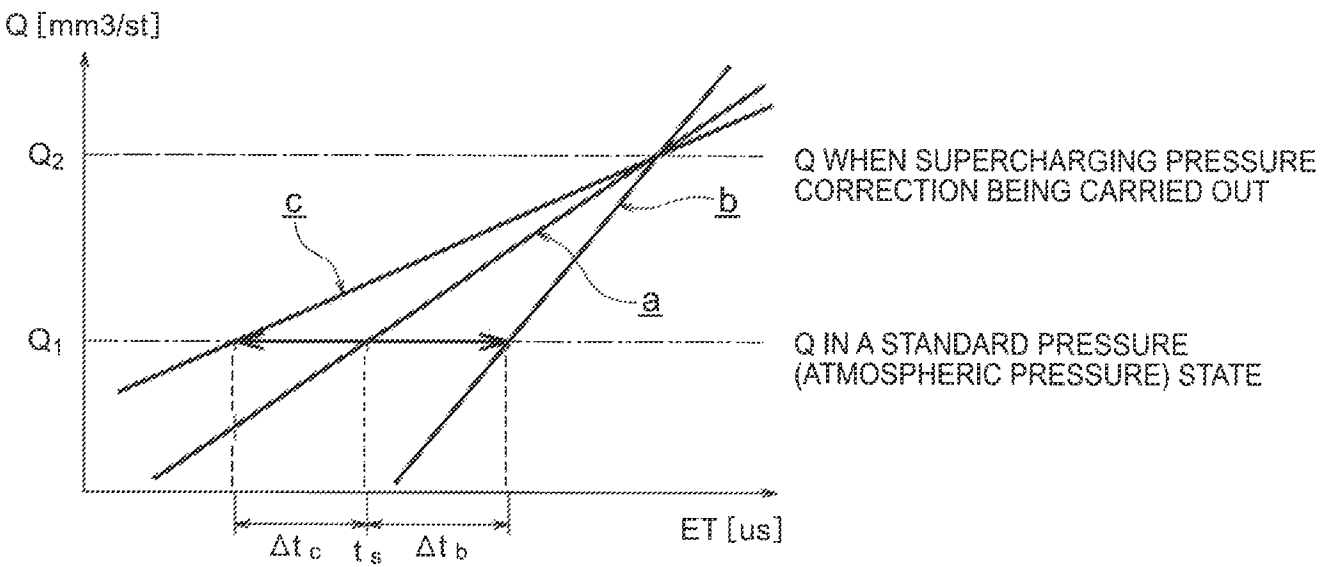
FIG. 10 is a characteristic diagram showing an example of a characteristic curve showing the relationship between an energizing time and a fuel injection amount for explaining the influence which the irregularities in a fuel injection valve characteristic exerts on correction accuracy of a fuel injection amount.

Here, the worsening of the correction accuracy in a fuel injection amount correction control when a vehicle is at a high land is explained in conjunction with FIG. 10.

Firstly, conventionally, at a high land, even when the fuel injection is performed with a minute injection amount equal to an injection amount when the vehicle is at a low land, due to the deviation of combustion timing generated by the lowering of density of air or the like, an original change in rotation cannot be acquired and hence, the original variation is acquired by increasing an injection amount corresponding to a supercharging pressure.

For example, assume that a fuel injection amount is at a level indicated by a double-dashed chain horizontal line in FIG. 10 when a fuel injection valve is driven for a certain energizing time under standard pressure (atmospheric pressure).

It is also assumed that the supercharging pressure correction as described above is applied to such a fuel injection valve at a high land such that an amount of variation in rotation equal to an amount of variation in rotation acquired at a flat land is acquired, a fuel injection amount Q is set to a level Q2 indicated by a single chained horizontal line in FIG. 10 and, further, a characteristic of a change in injection amount with respect to the energizing time in such a case is expressed by a solid characteristic curve which is given with symbol in the same drawing.

In such a state, a learnt value which is acquired by learning processing of the energizing time, that is, a differential energizing time learnt value ΔET which is stored in the energizing time learnt value map (see symbol M2-5 in FIG. 2) has the significance as a learnt value under standard pressure (atmospheric pressure) substantially.

However, when irregularities occur in characteristics of a change in injection amount with respect to the energizing time of the fuel injection valve as indicated by solid lines which are given with symbol b and symbol c in FIG. 10 caused by the deterioration of the fuel injection valve or the like, an energizing time required for acquiring an injection amount Q1 at a standard pressure (atmospheric pressure) has, as shown in FIG. 10, the deviations Δtb and the deviation Δtc with respect to an energizing time is required for acquiring the injection amount Q1 by the previously-mentioned fuel injection valve having the characteristic to which symbol a is given. Accordingly, the deviation is also generated in the differential energizing time learnt value ΔET which is a learnt value along with the generation of such deviations Δtb, Δtc thus leading to the worsening of the correction accuracy in the fuel injection amount correction control.

According to the second embodiment, the worsening of the correction accuracy in the fuel injection amount correction control caused by the above-mentioned irregularities of injection characteristic of the fuel injection valve can be decreased by lowering a target value of an amount of variation in rotation, that is, by lowering a threshold value with respect to an estimated injection amount which is acquired based on the amount of variation in rotation thus lowering a supercharging pressure correction amount.

Next, the steps of the fuel injection amount correction processing according to the second embodiment executed by an electronic control unit 4 are explained in conjunction with FIG. 7 to FIG. 12.

The steps having the same processing contents as the processing contents of the steps shown in FIG. 4 and FIG. 5 are given the same step number and the detailed explanation of these steps is omitted. Hereinafter, the explanation is made by focusing on points which make this embodiment differ from the first embodiment.

Figure 7:
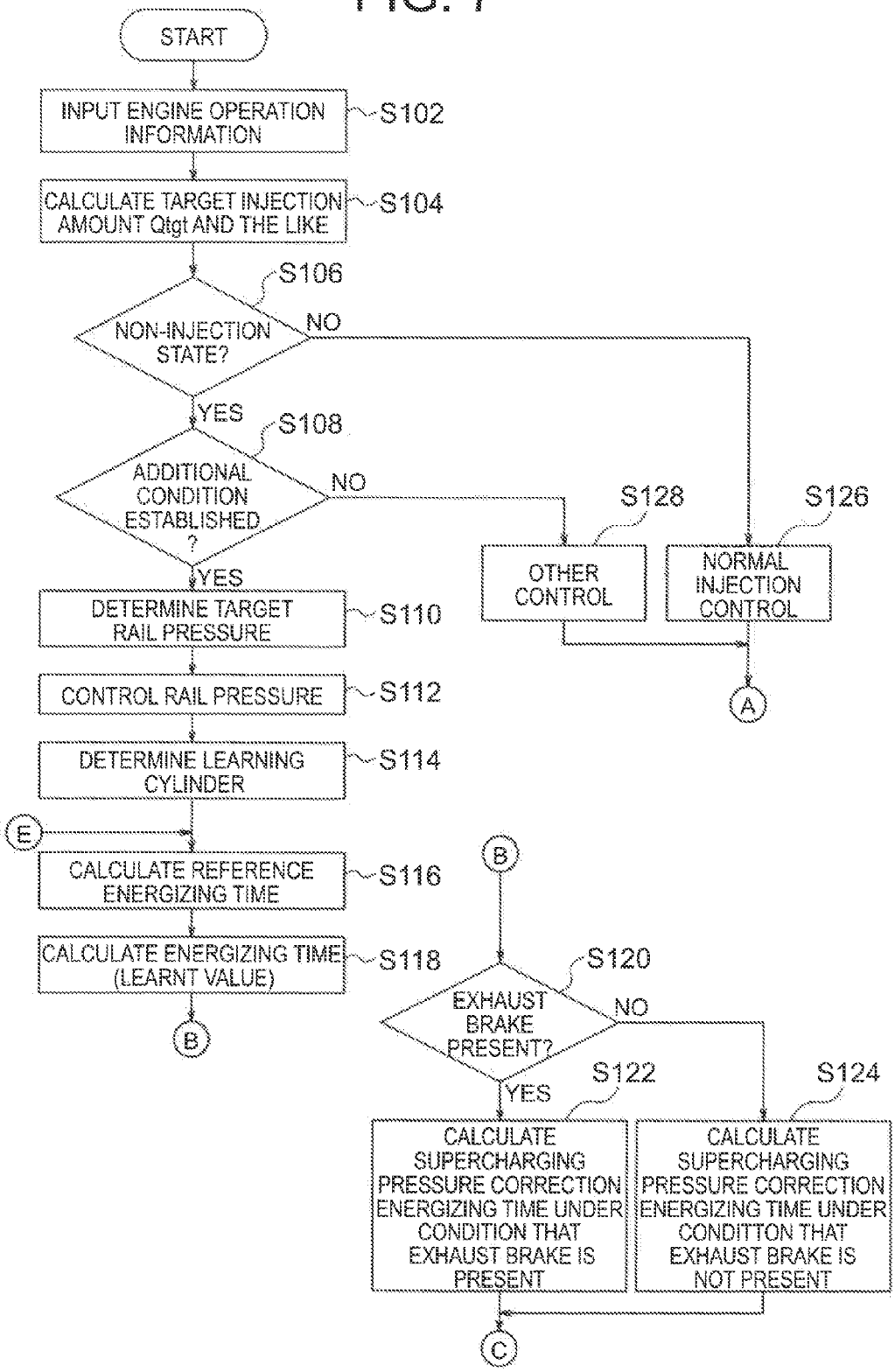
FIG. 7 is a flowchart of a sub routine showing steps of a front half portion of fuel injection amount correction processing in the second embodiment executed by the electronic control unit.

When the processing by the electronic control unit 4 is started, in the same manner as the processing which is explained in conjunction with the sub routine flowchart shown in FIG. 4 previously, the processing of inputting various operation information indicative of an operation state of an engine 3, the processing of calculating a target fuel injection amount Qtgt necessary for a fuel injection control and confirming a learning cylinder and the like are executed (see steps S102 to S114 in FIG. 7), and, next, a reference energizing time corresponding to a target rail pressure and a fuel injection amount at this point of time is read from the reference energizing time map (see step S116 in FIG. 7).

When it is determined that the operation state of the engine 3 is not the non-injection state (when the determination is negative) in step S106, the processing returns to a main routine not shown in the drawing through step S126, and when it is determined that an addition condition is not established in step S108 (when the determination is negative), the processing returns to the main routine not shown in the drawing through step S128.

Subsequent to step S116, the energizing time calculation using a learnt value is performed (see step S118 in FIG. 7). That is, the energizing time is calculated in such a manner that a differential energizing time learnt value ΔET corresponding to the target rail pressure determined in step S112 and the fuel injection amount is read from the energizing time learning map (see symbol M2-5 in FIG. 2), and the differential energizing time learnt value ΔET is added to the reference energizing time.

Next, it is determined whether or not an exhaust brake is in an operation state (see step S120 in FIG. 7). When it is determined that the exhaust brake operation is underway (when the determination is affirmative), the processing advances to processing in step S122 described next. On the other hand, when it is determined that the exhaust brake operation is not underway (when the determination is negative), the processing advances to processing in step S124 described later.

In step S122, the energizing time which is calculated in proceeding step S118 is corrected using a predetermined correction formula by taking into account that the exhaust brake operation is underway and the magnitude of a supercharging pressure. The predetermined correction formula is set based on a result of a test, a result of a simulation or the like.

On the other hand, in step S124, the energizing time calculated in preceding step S118 is corrected using a predetermined correction formula by taking into account that the exhaust brake operation is not underway and the magnitude of a supercharging pressure. The predetermined correction formula is set based on a result of a test, a result of a simulation or the like.

Figure 8:
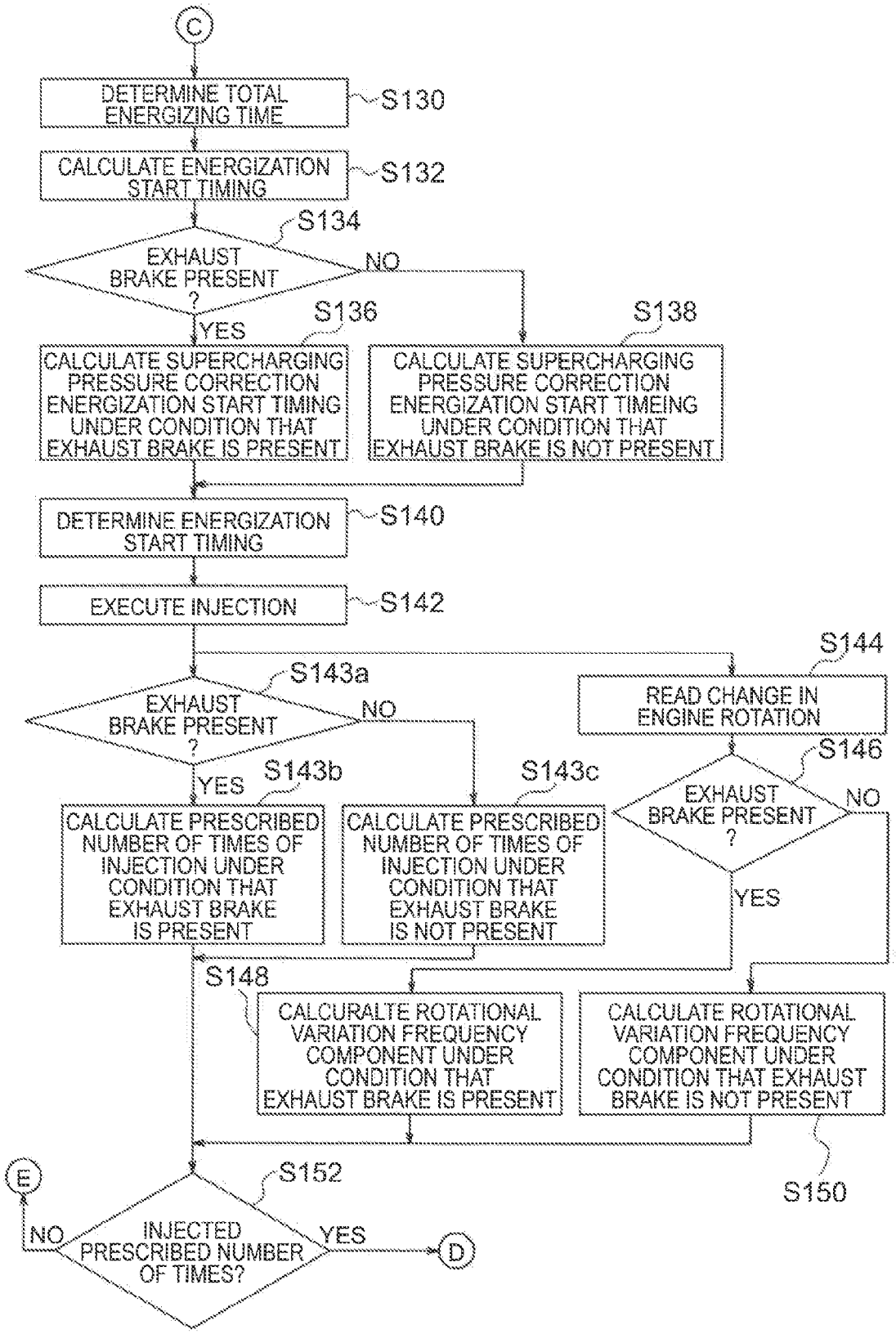
FIG. 8 is a flowchart of the sub routine showing steps of an intermediate portion of fuel injection amount correction processing in the second embodiment executed by the electronic control unit.

By executing the processing in step S112 or the processing in step S124 as described above, the total energizing time, that is, the final energizing time corresponding to the presence or the non-presence of an operation of the exhaust brake or the like is determined (see step S130 in FIG. 8).

Further, energizing start timing is calculated using a predetermined calculation formula based on an engine speed and a target rail pressure (see step S132 in FIG. 8).

Next, it is determined whether or not the exhaust brake is in an operation state again (see step S134 in FIG. 8). When it is determined that the exhaust brake operation is underway (when the determination is affirmative), the processing advances to processing in step S136 described next, while when it is determined that the exhaust brake operation is not underway (when the determination is negative), the processing advances to processing in step S138 described later.

In step S136, usually, the energizing start timing which is decided based on an engine speed and a target rail pressure is acquired with correction using a predetermined correction formula by taking into account that the exhaust brake operation is underway and the magnitude of a supercharging pressure. The predetermined correction formula is set based on a result of a test, a result of a simulation or the like.

On the other hand, in step S138, usually, the energizing start timing which is decided based on an engine speed and a target rail pressure is acquired with correction using a predetermined correction formula by taking into account that the exhaust brake operation is not underway and the magnitude of a supercharging pressure.

By executing the processing in step S136 or the processing in step S138 as described above, the final energizing start timing is set (see step S140 in FIG. 7), and the fuel injection to the cylinder specified in preceding step S114 is performed at this set energizing start timing for the energizing time set in preceding step S130 (see step S142 in FIG. 7).

A series of processing in step S143*a*, step S143*b* and step S143*c* described next and a series of processing in step S144, step S146, step S148 and step S150 are executed parallel to each other by so-called time sharing processing.

Firstly, in step S143*a*, it is determined whether or not the exhaust brake is in an operation state. When it is determined that the exhaust brake operation is underway (when the determination is affirmative), the processing advances to processing in step S143*b* described next. On the other hand, when it is determined that the exhaust brake operation is not underway (when the determination is negative), the processing advances to processing in step S143*c* described later.

In step S143*b*, the calculation of the prescribed number of times of injection is performed.

The prescribed number of times of injection is usually calculated using a formula for calculating the predetermined prescribed number of times of injection based on the magnitude of a supercharging pressure. However, in step S143*b*, the prescribed number of times of injection which takes into account the fact that the exhaust brake operation is underway is calculated by a formula for calculating the prescribed number of times of injection which is modified so that the fact that the exhaust brake operation is underway is taken into account in the calculation of the prescribed number of times of injection.

Further, in step S143*c*, the prescribed number of times of injection which takes into account a fact that the exhaust brake operation is not underway is calculated based on a formula for calculating the prescribed number of times of injection which is modified so that the fact that the exhaust brake operation is not underway is taken into account in the calculation of the prescribed number of times of injection.

As the general tendency, when a supercharging pressure is low, the stability of a combustion state of the engine 3 is wrong and hence, it is necessary to enhance the reliability of an acquired rotational variation frequency component by increasing the number of times of injection of minute injection amount. On the other hand, when a supercharging pressure is high, the combustion state of the engine 3 is stabilized and hence, the number of times of injection of minute injection amount can be made relatively small and hence, a reliable rotational variation frequency component can be acquired.

On the other hand, in step S144, the reading of a variation in an engine speed generated by the execution of the fuel injection is performed. That is, the reading of an amount of variation in a rotational speed of the engine 3 is performed in response to inputting of an engine speed signal to the electronic control unit 4.

Next, it is determined whether or not the exhaust brake operation is underway (see step S146 in FIG. 8). When it is determined that the exhaust brake operation is underway (when the determination is affirmative), the processing advances to processing in step S148. In this step S148, a frequency component corresponding to an amount of variation in rotation (rotational variation frequency component) is calculated based on the amount of variation in engine rotation which is acquired in preceding step S144 by making the amount of variation in engine rotation pass through a band pass filter by software processing in the electronic control unit 4 as described previously. In this step S148, in executing such calculation, the frequency component is calculated with correction by taking into account, at least, the fact that the exhaust brake operation is underway, the magnitude of a supercharging pressure and setting of gears.

Further, in step S146, when it is determined that the exhaust brake operation is not underway (when the determination is negative), the processing advances to processing in step S150, wherein a frequency component corresponding to an amount of variation in rotation (rotational variation frequency component) is calculated based on the amount of variation in engine rotation which is acquired in preceding step S144 by making the amount of variation in engine rotation pass through a band pass filter by software processing in the electronic control unit 4 as described previously. In this step S150, the frequency component is calculated with correction by taking into account, at least, the fact that the exhaust brake operation is not underway, the magnitude of a supercharging pressure and setting of gears.

With respect to a specific method for correcting the rotational variation frequency component by taking into account the presence or the non-presence of an operation of the exhaust brake, the magnitude of a supercharging pressure and setting of gears, it is preferable to select a proper method based on a result of a test, a result of a simulation or the like by taking into account various specific conditions of a vehicle.

After either one of the processing in step S143*b* and the processing in step S143*c* and either one of the processing in step S148 and the processing in step S150 are executed, it is determined whether or not the number of times of injection reaches the prescribed number of times (see step S152 in FIG. 8). When it is determined that the number of times of injection does not reach the prescribed number of times (when the determination is negative), the processing returns to the processing in preceding step S116 (see FIG. 7), and the similar processing is repeated. On the other hand, when it is determined that the number of times of injection reaches the prescribed number of times (when the determination is affirmative), the processing advances to processing in step S154 (see FIG. 9) described next.

Here, the prescribed number of times of injection is usually calculated by the predetermined prescribed number of times of injection calculation formula based on the magnitude of a supercharging pressure.

In step S154 (see FIG. 9), an estimated injection amount is calculated based on the rotational variation frequency component acquired in step S148 or in step S150. That is, an estimated injection amount in the fuel injection which is previously performed the prescribed number of times is calculated as an average value.

Figure 9:
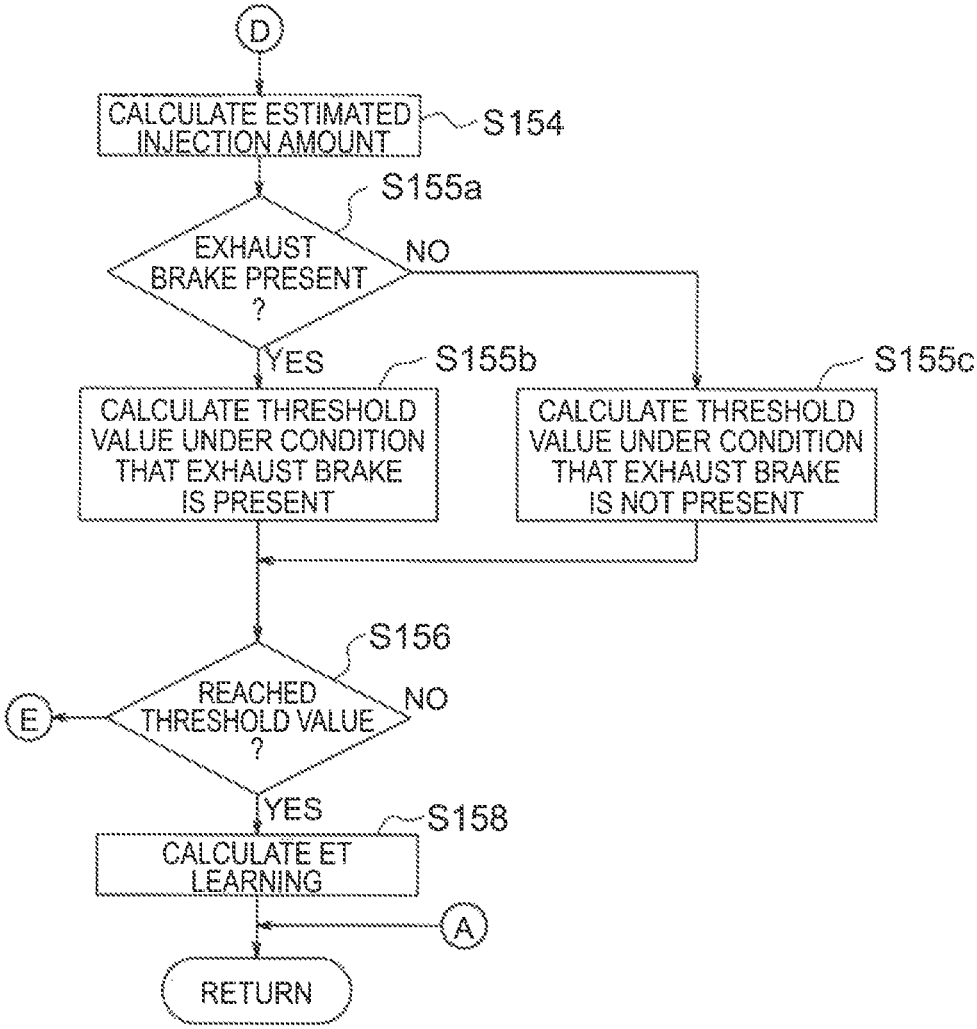
FIG. 9 is a flowchart of the sub routine showing steps of a last portion of fuel injection amount correction processing in the second embodiment executed by the electronic control unit.

Next, it is determined whether or not the exhaust brake is in an operation state (see step S155*a* in FIG. 9). When it is determined that the exhaust brake operation is underway (when the determination is affirmative), the processing advances to processing in step S155*b*. In step S155*b*, the calculation of a threshold value which takes into account the fact that the exhaust brake operation is underway is performed (see symbol M6-2 in FIG. 6). That is, the threshold value is usually calculated using a predetermined threshold value calculation formula based on the magnitude of a supercharging pressure. However, in this step S155*b*, a threshold value which takes into account the fact that the exhaust brake operation is underway is calculated using a threshold value calculation formula which is modified such that the fact that the exhaust brake operation is underway can be taken into account in the calculation of the threshold value.

On the other hand, in step S155*a*, when it is determined that the exhaust brake operation is not underway (when the determination is negative), the processing advances to processing in step S155*c*, wherein the calculation of a threshold value which takes into account the fact that the exhaust brake operation is not underway is performed (see symbol M6-2 in FIG. 6). That is, the threshold value is usually calculated using a predetermined threshold value calculation formula based on the magnitude of a supercharging pressure. However, in this step S155*c*, a threshold value which takes into account the fact that the exhaust brake operation is not underway is calculated using a threshold value calculation formula which is modified such that the fact that the exhaust brake operation is not underway can be taken into account in the calculation of the threshold value.

The reason that the presence or the non-presence of the operation of the exhaust brake is taken into account in setting the threshold value as described above is that, although the presence or the non-presence of the operation of the exhaust brake influences the supercharging pressure, the supercharging pressure influences an amount of variation in an engine speed and hence, the presence or the non-presence of an operation of the exhaust brake is taken into account for suppressing the influence.

Figure 12A:
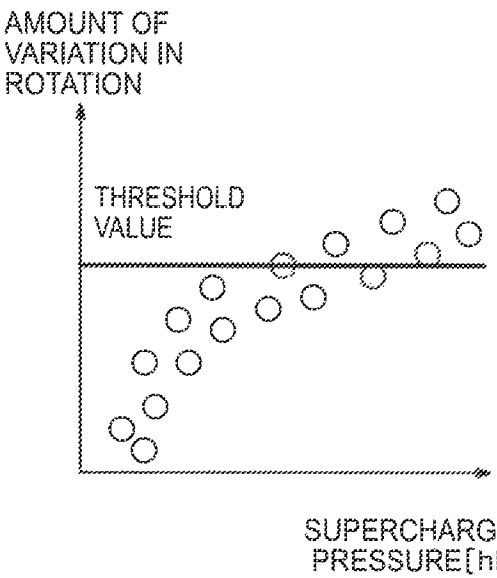
Figure 12B:
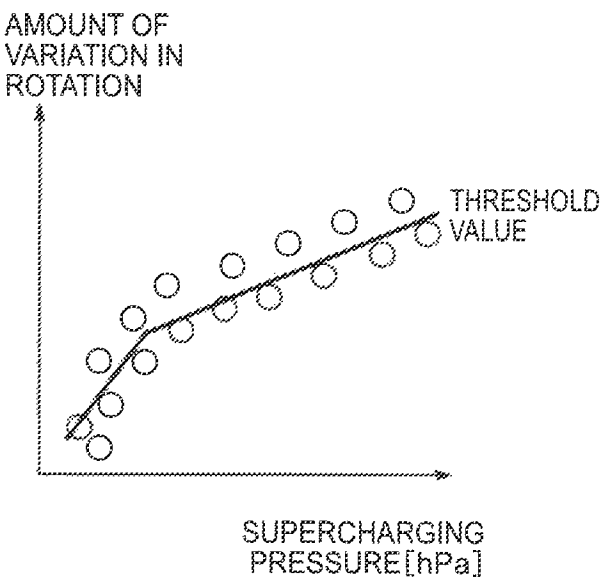

That is, when the supercharging pressure is low, the engine 3 is in a state where an oxygen amount is small and the combustion is hardly produced and hence, even when the injection of minute injection amount for a fuel injection amount correction control is performed, a variation in an engine speed is slow. For example, FIG. 12A and FIG. 12B are schematic characteristic curve charts schematically showing the schematic correlation between a supercharging pressure and an amount of variation in rotation. Particularly, in FIG. 12A, the schematic correlation between a supercharging pressure and an amount of variation in rotation when the threshold value is fixed is shown. It is confirmed that an amount of variation in rotation is small when the supercharging pressure is low. Here, in FIG. 12A and FIG. 12B, a blanked circle indicates an amount of variation in rotation with respect to individual supercharging pressure.

Accordingly, in the mode for carrying out the present invention, by lowering a threshold value of a target rotation change corresponding to a supercharging pressure influenced by the presence or the non-presence of the operation of the exhaust brake as described above, an injection amount substantially equal to an injection amount which brings about a rotation change prescribed at a normal state can be acquired.

FIG. 12B shows the schematic correlation between a change in threshold value and the amount of variation in rotation which takes into account a supercharging pressure as described above, and it is confirmed that the threshold value is lowered along with the lowering of the supercharging pressure.

After either one of the processing in step S155*b* and the processing in step S155*c* is executed as described above, it is determined whether or not the estimated injection amount which is calculated in step S154 previously is converged to the threshold value which is calculated in step S155*b* or step S155*c* (see step S156 in FIG. 9).

When it is determined that the estimated injection amount is converged to the threshold value (when the determination is affirmative) in step S156, the energizing time learning calculation is performed (see step S158 in FIG. 9). On the other hand, when it is determined that the estimated injection amount is not converged to the threshold value yet (when the determination is negative), the processing returns to processing in preceding step S116 (see FIG. 7), and the similar processing is repeated.

The specific content of the conversion of the estimated injection amount to the threshold value and the energizing time learning are equal to those of the first embodiment (see FIG. 4 and FIG. 5) and hence, the detailed explanation of these matters is omitted here.

Figure 13:
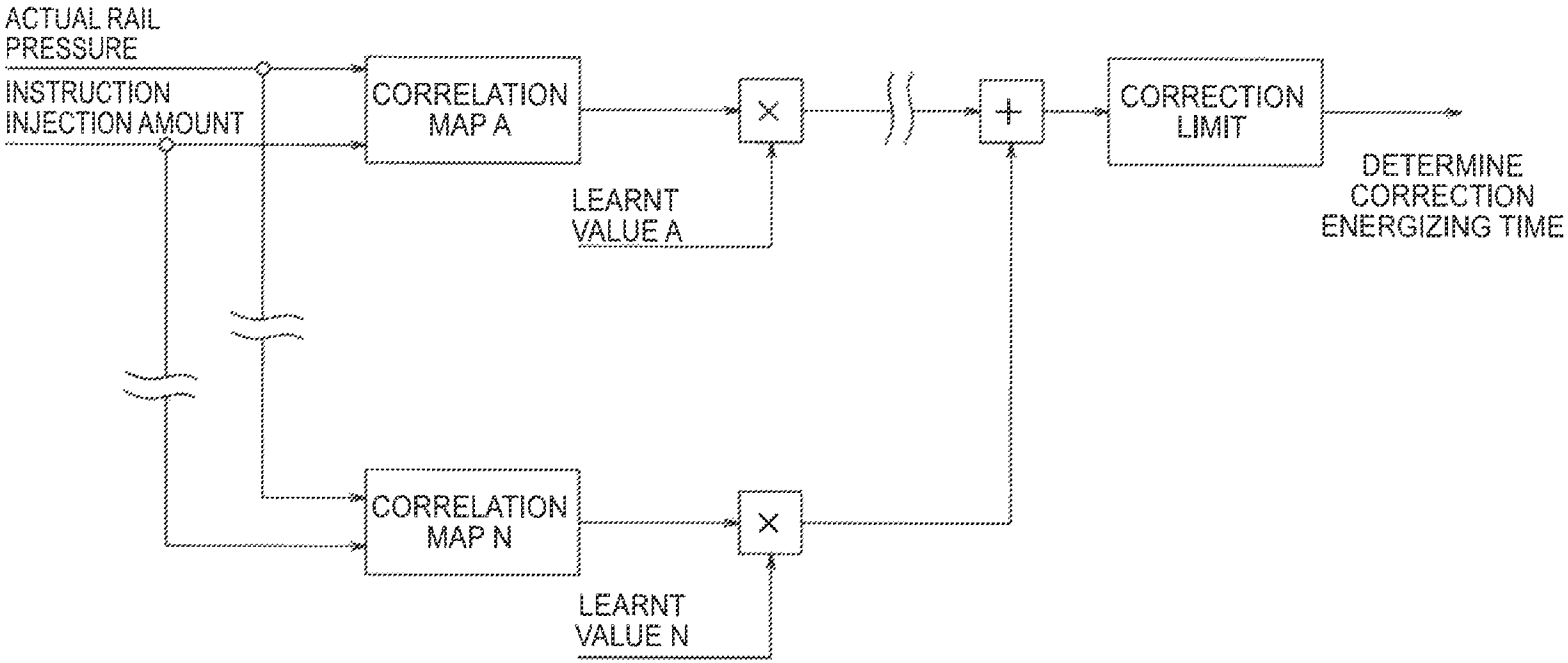
FIG. 13 is a schematic view schematically showing processing steps of calculating a correction energizing time using an energizing time learnt value in the mode for carrying out the present invention.
Figure 14:
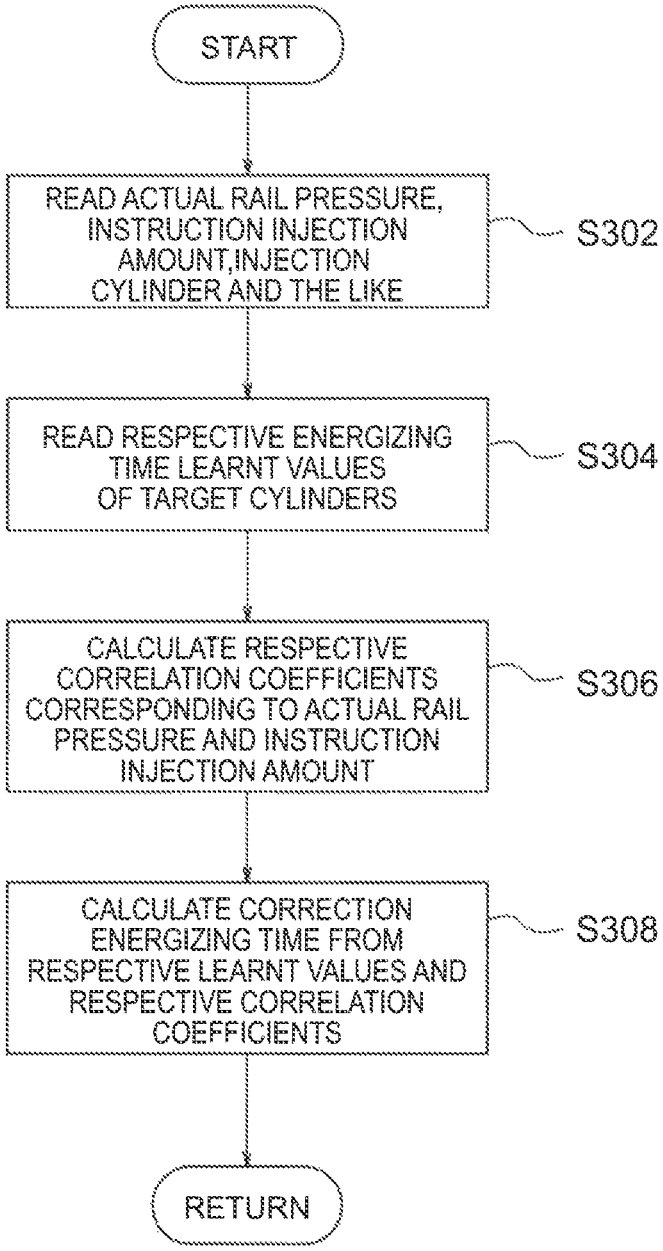
FIG. 14 is a sub routine flowchart showing processing steps of calculating a correction energizing time using an energizing time learnt value executed by an electronic control unit in the mode for carrying out the present invention.

Next, the manner in which the energizing time learnt value acquired in the first embodiment or the second embodiment described above is reflected on the energizing time setting in fuel injection is explained in conjunction with FIG. 13 and FIG. 14 by taking one method as an example.

Firstly, FIG. 13 is a schematic view which schematically shows processing steps of calculating a correction energizing time using an energizing time learnt value which is executed by the electronic control unit 4. Hereinafter, the explanation is made in conjunction with FIG. 13.

Firstly, as has been explained in conjunction with the first and second embodiments previously, in the embodiments of the present invention, "energizing time learnt value" is acquired by correcting the reference energizing time (symbol M2-1 in FIG. 2) with the differential energizing time learnt value ΔET (see symbol M2-5 in FIG. 2).

In the mode for carrying out the present invention, the energizing time learnt value is further corrected as explained hereinafter corresponding to an actual rail pressure and an instruction injection amount (target injection amount) thus setting the correction energizing time which is eventually used for energization.

The energizing time learnt value is a value which is acquired for every rail pressure as has been explained in conjunction the first and second embodiments previously. Accordingly, corresponding to such acquisition of the energizing time learnt values, in a proper memory area of the electronic control unit 4, correlation maps which determine degrees that the respective energizing time learnt values are reflected on energizing times of actual fuel injection are stored, wherein the number of correlation maps is equal to the number of energizing time learnt values. FIG. 13 shows an example where when the number of energizing time learnt values for the respective rail pressures is N, in other words, when the energizing time learnt values are provided for N pieces of rail pressures, N pieces of correlation maps A to N are provided corresponding to the energizing time learnt values.

The correlation maps A to N are set such that each correlation map uses an actual rail pressure and an instruction injection amount as input parameters, and can read a correction coefficient (correlation coefficient) which determines a rate at which the energizing time learnt value is used for setting an actual energizing time in response to the combination of two inputs.

When the correlation coefficients are read out based on the actual rail pressure and the instruction injection amounts, the correlation coefficients are multiplied by the respectively corresponding energizing time learnt values, and the sum of the respective multiplication results is obtained.

For example, to facilitate the understanding of the above setting of correction energizing time, the explanation is made by taking a case where the energizing time learnt values are prepared for two rail pressures (for example, 30 Mpa and 50 Mpa) as an example. In this case, two correlation maps are provided corresponding to two rail pressures.

For example, assume that an energizing time learnt value for the rail pressure of 30 Mpa is A, a correlation coefficient read from the correlation map A is 0.45, an energizing time learnt value for a rail pressure of 50 Mpa is B, and a correlation coefficient read from the correlation map B is 0.65. In this case, the calculation of 0.45×A+0.65×B is performed.

The sum of the respective multiplication results of the energizing time learnt values and the correlation coefficients acquired as described above is used for energization driving of the fuel injection valves 2-1, . . . , 2-*n* as a final energizing time (correction energizing time) with a correction limit which excludes the sum of the multiplication result exceeding a preset limit value. Such a correction energizing time is, as has been explained previously, an energizing time to which the correction for the deviation of energizing start timing and the deviation of fuel injection amount is made.

FIG. 14 is a sub routine flowchart which shows processing steps for calculating a correction energizing time using the above-mentioned energizing time learnt value executed in the electronic control unit 4. Hereinafter, the content of the calculation processing steps is explained in conjunction with drawings.

When the processing executed by the electronic control unit 4 is started, firstly, the reading of information on an actual rail pressure, an instruction injection amount, the fuel injection valves 2-1, . . . , 2-*n* which are object to be processed, and a cylinder which is an object to be processed and the like are performed (see step S302 in FIG. 14).

These information are sequentially updated and stored in a predetermined memory area of the electronic control unit 4 by the fuel injection control processing which is executed in a main routine not shown in the drawing, for example. In step S302, it is sufficient to perform the reading of information from the memory area.

Next, the reading of the energizing time learnt values for respective rail pressures is performed with respect to cylinders which are objects to be processed by the correction processing of an energizing time learnt value specified in step S302 (see step S304 in FIG. 14).

Then, the calculation of the respective correlation coefficients corresponding to actual rail pressures and instruction injection amounts is performed (see step S306 in FIG. 14). That is, the correlation coefficients corresponding to the actual rail pressures and the instruction injection amounts are respectively read from the respective correlation maps which are provided corresponding to the above-mentioned energizing time learnt values (see FIG. 13).

Next, the calculation of final energizing times, in other words, the calculation of correction energizing times is performed using the respective correlation coefficients which correspond to the respective energizing time learnt values (see step S308 in FIG. 14). That is, as has been explained previously by taking an example in conjunction with FIG. 13, assuming that, for example, energizing time learnt values A, B are acquired with respect to two rail pressures, and correlation coefficients which are read from correlation maps which correspond to the energizing time learnt values A, B respectively are set such that the correlation coefficient corresponding to the energizing time value A is 0.45 and the correlation coefficient corresponding to the energizing time value B is 0.65, the correction energizing time is calculated by $0.45\times A+0.65\times B$, and a calculated value is used for energization driving of the fuel injection valves which are objects to be processed.

The energizing time which is used for the energization driving of the fuel injection valves as described above, as has been previously explained in conjunction with the first and second embodiments, corrects not only an energizing time per se corresponding to a change in an injection characteristic caused by the deterioration of the fuel injection valve or the like but also energization start timing in a process of acquiring an energizing time learnt value (see steps S136, S138 in FIG. 5) and hence, it is possible to acquire a more accurate correction energizing time.

According to the present invention, in the fuel injection amount correction control performed by the common-rail-type fuel injection control device, the presence or the non-presence of the operation of the exhaust brake and the magnitude of the supercharging pressure can be taken into account in the control. Accordingly, the present invention can acquire an advantageous effect that the worsening of the correction accuracy in the fuel injection amount correction control caused by the deterioration of the fuel injection valve or the like can be prevented or suppressed and hence, the correction accuracy can be enhanced, and the correction accuracy in the fuel injection amount correction control at a high land can be also enhanced.

Further, particularly, in the fuel injection amount correction control, the threshold value of the amount of variation in rotation which becomes the reference of determination of whether or not the fuel injection amount correction is performed is corrected corresponding to the magnitude of the supercharging pressure, and the number of times of minute injection for acquiring the learnt value is corrected corresponding to the magnitude of the supercharging pressure. Accordingly, the worsening of the correction accuracy of the fuel injection amount correction control due to lowering of the air density at a high land or the like can be prevented or suppressed whereby the correction accuracy can be enhanced. Further, unlike the prior art, the present invention can acquire an advantageous effect that the fuel injection amount at a high land can be set to an appropriate value and hence, a combustion sound and vibrations at the time of performing a learning operation due to lowering of an injection amount can be decreased. Still further, since the correction accuracy can be enhanced, the present invention can also acquire an advantageous effect that the fuel consumption can be enhanced due to injection with a proper injection amount and an exhaust gas characteristic can be enhanced.

The present invention is applicable to a fuel injection control device where it is desirable to perform a fuel injection with a proper fuel injection amount without being influenced by irregularities of fuel injection characteristics caused by the deterioration of a fuel injection valve or the like.

What is claimed is:

1. A method for correcting a fuel injection amount in a common-rail-type fuel injection control device, the method comprising:

injecting a minute amount of fuel a plurality of times when a fuel injection valve is in a non-injection state;

estimating an injection amount based on an amount of variation in an engine speed generated during the injection of the minute amount of fuel;

determining a difference between a reference energizing time and an energizing time at the time of injection the minute amount of fuel, the reference energizing time corresponding to the estimated injection amount and a rail pressure during the injection of the minute amount of fuel, and acquired from a reference energizing time map, generated at the time of mounting the fuel injection valve, having a rail pressure and a fuel injection amount as input parameters;

storing the difference between the reference energizing time and the energizing time at the time of injection the minute amount of fuel;

correcting a subsequent energizing time based on the stored difference;

correcting a deviation of a fuel injection amount caused by a deviation of an injection characteristic of the fuel injection valve;

calculating an engine speed based on an amount of variation in a frequency component of an engine rotational signal;

further correcting the corrected energizing time based on the presence or absence of an operation of an exhaust brake and a magnitude of a supercharging pressure; and further correcting the calculated engine speed based on the presence or absence of the operation of an exhaust brake and the magnitude of the supercharging pressure.

2. The method according to claim 1, wherein energizing start timing with respect to the fuel injection valve for starting minute injection which is acquired based on at least the engine speed and the target rail pressure is corrected corresponding to the presence or the non-presence of an operation of an exhaust brake and the magnitude of a supercharging pressure.

3. A method for correcting a fuel injection amount in a common-rail-type fuel injection control device, the method comprising:

injecting a minute amount of fuel a plurality of times when a fuel injection valve is in a non-injection state;

estimating an injection amount based on an amount of variation in an engine speed generated during the injection of the minute amount of fuel;

determining a difference between a reference energizing time and an energizing time at the time of injection the minute amount of fuel, the reference energizing time corresponding to the estimated injection amount and a rail pressure during the injection of the minute amount of fuel, and acquired from a reference energizing time map, generated at the time of mounting the fuel injection valve, having a rail pressure and a fuel injection amount as input parameters;

storing the difference between the reference energizing time and the energizing time at the time of injection the minute amount of fuel;

correcting a subsequent energizing time based on the stored difference;

correcting a deviation of a fuel injection amount caused by a deviation of an injection characteristic of the fuel injection valve;

calculating an engine speed based on an amount of variation in a frequency component of an engine rotational signal;

correcting a calculated, based on a magnitude of a supercharging pressure, prescribed number of times to inject the minute amount of fuel based on the presence or the absence of an operation of an exhaust brake, and updating the difference between a reference energizing time and an energizing time at the time of injection the minute amount of fuel when the estimated injection amount converges with a predetermined threshold calculated based on a magnitude of the supercharging pressure and corrected based on the presence or the absence of the operation of the exhaust brake.

4. A common-rail-type fuel injection control device having an electronic control unit which executes an operation control of an internal combustion engine, the electronic control unit configured to:

inject a minute amount of fuel a plurality of times when a fuel injection valve is in a non-injection state;

estimate an injection amount based on an amount of variation in an engine speed generated during the injection of the minute amount of fuel;

determine a difference between a reference energizing time and an energizing time at the time of injection the minute amount of fuel, the reference energizing time corresponding to the estimated injection amount and a rail pressure during the injection of the minute amount of fuel, and acquired from a reference energizing time map, generated at the time of mounting the fuel injection valve, having a rail pressure and a fuel injection amount as input parameters;

store the difference between the reference energizing time and the energizing time at the time of injection the minute amount of fuel;

correct a subsequent energizing time based on the stored difference;

correct a deviation of a fuel injection amount caused by a deviation of an injection characteristic of the fuel injection valve;

calculate an engine speed based on an amount of variation in a frequency component of an engine rotational signal;

further correct the corrected energizing time based on the presence or absence of an operation of an exhaust brake and a magnitude of a supercharging pressure; and further correct the calculated engine speed based on the presence or absence of the operation of an exhaust brake and the magnitude of the supercharging pressure.

5. The common-rail-type fuel injection control device according to claim 4, wherein the electronic control unit is configured such that energizing start timing with respect to the fuel injection valve for starting minute injection which is acquired based on at least the engine speed and the target rail pressure is corrected corresponding to the presence or the non-presence of an operation of an exhaust brake and the magnitude of a supercharging pressure.

6. A common-rail-type fuel injection control device having an electronic control unit which executes an operation control of an internal combustion engine, the electronic control unit being configured such that minute injection which is fuel injection of a minute injection amount is performed plural times when a fuel injection valve is in a non-injection state;

an estimated injection amount which is estimated to be injected at the time of performing the minute injection is calculated based on an amount of variation in an engine speed generated in the minute injection;

the difference between a reference energizing time corresponding to the estimated injection amount and a rail pressure at the time of performing the minute injection which is acquired from a reference energizing time map from which an energizing time acquired at the time of mounting the fuel injection valve with respect to various rail pressures and fuel injection amounts is readable as the reference energizing time using a rail pressure and a fuel injection amount as input parameters and an energizing time at the time of performing the minute injection is calculated, a result of calculation of the difference is stored as a learnt value in an updatable manner, and at the time of performing fuel injection subsequently, a value acquired by correcting the reference energizing time with the learnt value is set as an energizing time, so that the deviation of a fuel injection amount caused by the deviation of an injection characteristic of the fuel injection valve is correctable, and the amount of variation in the engine speed is calculated based on a rotational variation frequency component which is an amount of variation in a frequency component of an engine rotation signal, wherein the electronic control unit is configured such that a prescribed number of times of injection of the minute injection calculated based on the magnitude of a supercharging pressure is corrected based on the presence or the non-presence of an operation of an exhaust brake, and updating of the learnt value is allowed when the estimated injection amount is converged to a predetermined threshold value, and the predetermined threshold value calculated based on the magnitude of the supercharging pressure is corrected based on the presence or the non-presence of the operation of the exhaust brake.

* * * * *